US006418997B1

(12) United States Patent
Tamai et al.

(10) Patent No.: US 6,418,997 B1
(45) **Date of Patent: *Jul. 16, 2002**

(54) TAPE CARTRIDGE FOR COAT FILM TRANSFER TOOL AND COAT FILM TRANSFER TOOL

(75) Inventors: Shigeru Tamai, Ikeda; Kouhei Koyama, Kyoto; Masatoshi Shintani, Sanda, all of (JP)

(73) Assignee: Seed Rubber Company Limited, Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/348,243

(22) Filed: Jul. 6, 1999

(30) Foreign Application Priority Data

Jul. 8, 1998 (JP) ..... 10-210363

(51) Int. Cl.[7] ..... B32B 31/00

(52) U.S. Cl. ..... 156/577; 156/579; 118/257; 118/76; 242/160.4; 242/171; 242/588.6

(58) Field of Search ..... 156/238, 523, 156/527, 540, 574, 577, 579; 225/46; 118/76, 200, 257; 242/160.2, 160.4, 170, 171, 588, 588.2, 588.3, 588.6

(56) References Cited

U.S. PATENT DOCUMENTS 5,310,437 A * 5/1994 Tucker ..... 156/577 X
5,490,898 A * 2/1996 Koyama ..... 156/577 X
5,556,469 A * 9/1996 Koyama et al. ..... 156/579 X
5,685,944 A * 11/1997 Nose et al. ..... 156/577 X
5,759,270 A * 6/1998 Lee ..... 156/577 X
5,792,263 A * 8/1998 Koyama et al. ..... 156/577 X
5,795,085 A * 8/1998 Yoo ..... 156/577 X
6,227,274 B1 * 5/2001 Koyama et al. ..... 118/257

* cited by examiner

*Primary Examiner*—Mark A. Osele
(74) *Attorney, Agent, or Firm*—Rader, Fishman & Grauer PLLC

(57) ABSTRACT

In a refill type coat film transfer tool for use in horizontal drawing, a small, simple and inexpensive tape cartridge is presented, in which the coat film transfer tape can be replaced easily, quickly and securely, and it can be held and used like a writing tool corresponding to the manner of holding a writing tool by the user. On a support board, a rotatable feed reel winding a coat film transfer tape thereon, a rotatable take-up reel for recovering the coat film transfer tape after use, and a coat film transfer head for pressing the coat film transfer tape to a transfer area are provided. The support board rotatably supports the opposite side ends of the rotary shafts of both reels detachably and rotatably supported on the rotary support shafts of the case of the coat film transfer tool, and the coat film transfer head is supported on the head holding portion of the support board rotatably about the head axial center.

31 Claims, 33 Drawing Sheets

C

TAPE CARTRIDGE FOR COAT FILM TRANSFER TOOL AND COAT FILM TRANSFER TOOL

BACKGROUND OF THE INVENTION

1. Field of the Invention

The present invention relates to a tape cartridge for coat film transfer tool and a coat film transfer tool, and more particularly to refill type coat film transfer tape mounting technology enabling to exchange coat film transfer tapes, in a coat film transfer tool for transferring a coat film such as corrective paint layer, marker paint layer, or adhesive layer on a coat film transfer tape, onto a sheet of paper or the like.

2. Description of the Related Art

An example of constitution of coat film transfer tool of this kind is disclosed in Japanese Utility Model Laid-open Publication No. 5-13800. In this coat film transfer tool, as shown in FIG. 32, in a case a that can be held and manipulated by one hand, a feed reel c mounting a coat film transfer tape b and a take-up reel d for recovering the coat film transfer tape b' after use are rotatably provided, and a coat film transfer head f for pressing the coat film transfer tape b onto the transfer area is projecting at the leading end of the case a. The both reels c, d are of self-winding type being mutually linked to cooperate by means of a linkage g. This linkage g is mutually engaged with gears h, i provided on the outer circumference of the both reels c, d.

The case a is a flat box having the contour dimension and width enough for incorporating the feed reel c and take-up reel d, and the flat face and back sides, that is, the face and back sides to the sheet of paper of FIG. 32 are the gripping surfaces when holding and manipulating by hand.

In this coat film transfer tool, the pressurizing portion j of the head f is composed so as to guide the coat film transfer tape b nearly oppositely to the gripping surfaces of the case a so as to be used in so-called horizontal drawing.

When such coat film transfer tool is used as an eraser for correcting a wrong character, it is suited to correction of letters written horizontally as in alphabet. The case a is held by hand, and while pressing the coat film transfer tape b tightly on the correction area (transfer area) k by the pressurizing portion j of the head f as shown in FIG. 32, the case a is moved in a specified direction (in the vertical direction to the sheet of paper of FIG. 32). As a result, the corrective paint layer of the coat film transfer tape b in the pressurizing portion j of the head f is adhered to the correction area k to erase the letter, while the coat film transfer tape b' after use is automatically taken up and recovered on the take-up reel d.

Recently, the effective use of the resources on earth is keenly demanded in particular, and this kind of coat film transfer tool is also desired to be manufactured in the so-called refill type structure for replacing only the consumable part of the coat film transfer tape b from the viewpoint of resource saving.

In such horizontal drawing type coat film transfer tool, however, since the pressurizing portion j of the head f is designed to guide the coat film transfer tape b almost oppositely to the gripping surfaces of the case a, it is practically impossible to employ the refill structure of replacing the coat film transfer tape b only.

That is, in this coat film transfer tool, structurally, the coat film transfer tape b is twisted 90 degrees in the head f portion. Hence, at the manufacturer's side, it is hard to automate the assembling work, and skilled workers are assembling manually at the present.

On the other hand, in the refill structure for replacing the consumable part of coat film transfer tape b, the user is requested to disassemble and reassemble the coat film transfer tool and replace the coat film transfer tape b. Therefore, in the refill structure of the coat film transfer tape b, it is an essential subject for development of structure so that the series of steps may be done easily and quickly by the general user.

From this point of view, the present applicant previously proposed the refill type coat film transfer tool in Japanese Patent Laid-open Publication No. 8-156495.

In this coat film transfer tool, as shown in FIG. 33, a replaceable tape cartridge m is provided in a case a, and this tape cartridge m comprises a feed reel c and a take-up reel d rotatably disposed on a support board n, and these reels c, d are detachably and integrally rotatably engaged respectively with a feed rotary portion o and a take-up rotary portion p rotatably provided in the case a. The both rotary portions o, p are mutually linked through a linkage g, and this linkage g is frictionally contacting with an O-ring r on the outer circumference of the feed rotary portion o and an outer circumference s of the take-up rotary portion p mutually.

At the leading end of the case a, a coat film transfer head f is projecting, and this coat film transfer head f is rotatable between the coat film transfer tape replacing position and the using position. The pressurizing portion j at the leading end of the coat film transfer head f is, at the coat film transfer tape replacing position, guides the coat film transfer tape b while the both reels c, d are in winding position, and at the using position, it is designed to guide the coat film transfer tape b almost oppositely to the gripping surfaces of the case a.

When using this coat film transfer tool, it can be used in horizontal drawing same as in the coat film transfer tool shown in FIG. 32, and, when replacing the coat film transfer tape b, the coat film transfer head f is rotated from the using position to the coat film transfer tape replacing position. As a result, the position of the coat film transfer tape b in the head f area is manipulated from the stated twisted about 90 degrees to the winding position of the feed reel c and take-up reel d to the parallel state, so that it is easy to mount and dismount the coat film transfer tape b on and from the head f, but there was a room for further improvement in the aspect of freedom from setting of coat film transfer tape b on the head f.

Also in the coat film transfer tools of horizontal drawing type shown in FIG. 32 and FIG. 33, the head structure was designed on the basis of the ideal and uniform position of holding a writing tool, but actually since each user holds the writing tool in a different manner, there was a further room for improvement in the aspect of realizing an optimum state for every user in the sense of holding a writing tool.

SUMMARY OF THE INVENTION

It is hence a main object of the invention to present a novel coat film transfer tape cartridge solving the problems of the prior arts.

It is other object of the invention to present a tape cartridge in a structure for replacing the coat film transfer tape more easily, quickly and securely by improving the refill type coat film transfer tool structure for horizontal drawing.

It is a different object of the invention to present a tape cartridge in a structure allowing every user to hold in a sense of holding a writing tool freely.

It is a further object of the invention to present a tape cartridge in a small, simple and inexpensive structure.

It is a further different object of the invention to present a coat film transfer tool having such tape cartridge structure.

In the constitution of the tape cartridge of the invention, a rotatable feed reel winding a coat film transfer thereon, a rotatable take-up reel for recovering the coat film transfer tape after use, and a coat film transfer head for pressing the coat film transfer tape onto the transfer area are provided on a flat support board, and this support board supports the opposite side ends of rotary shafts of the both reels detachably and rotatably supported on the rotary support shaft of the case of the coat film transfer tool, and the coat film transfer head has its base end support portion rotatably held around the head axis in the head holding portion of the support board.

In the constitution of the coat film transfer tool of the invention, such tape cartridge is detachably provided, and more specifically in the case to be held and manipulated by one hand, there is a rotary support shaft for detachably and rotatably supporting the feed reel and take-up reel of the tape cartridge, and by this rotary support shaft and the support board of the tape cartridge, the both reels are rotated and supported as being held on both sides, a head inserting portion for projecting the coat film transfer head of the tape cartridge to outside of the case is provided at the leading end of the case, and part of the outer circumference of the case forms a pair of opposite gripping surfaces to be held by hand like holding a writing tool.

In the tape cartridge of the invention, since the rotatable feed reel winding a coat film transfer thereon, rotatable take-up reel for recovering the coat film transfer tape after use, and coat film transfer head for pressing the coat film transfer tape onto the transfer area are provided on the flat support board, it can be replaced instantly.

That is, the support board rotatably supports the opposite side ends of the rotary shafts of the both reels supported on the rotary support shaft of the case, and setting of the coat film transfer tape on the coat film transfer head has been already completed in the stage of the product, and therefore the user has only to grip the support board to fit the rotary shaft of the reel onto the rotary support shaft of the case from the upper side, and push the tape cartridge into the case while positioning the coat film transfer head at a specified position at the leading end of the case, and thus the replacing procedure is completed.

Moreover, since the base end support portion of the coat film transfer head is rotatably held around the head axis in the head holding portion of the support board, in the state of the tape cartridge being placed in the case, the coat film transfer head is allowed to rotate about the head axis in a rotating angle range defined by the rotating angle defining portion of the head inserting portion of the case, and therefore the head position can be kept in an optimum state depending on the application or the manner of holding by the user. It means that in the coat film transfer tool of the invention, if the basic structure of the head is designed for a right-handed user, a left-handed user can hold the head position in a desired position, same as a right-handed user, depending on the manner of holding by the left-handed user.

In particular, the rotating angle defining portion is designed to set to allow the coat film transfer head to rotate so that the leading end pressurizing portion of the coat film transfer head may rotate in a specified angle range in both directions, from the center of angle of guiding the coat film transfer tape almost oppositely to the gripping surfaces of the case, and therefore the user can hold the coat film transfer tool in a position same as when holding a writing tool, so that it can be used in horizontal drawing same as when using a writing tool, so that a favorable sense of manipulation is obtained.

These and other related objects and features of the invention will be better understood by reading the following detailed description taken in conjunction with the accompanying drawings and novel matters pointed out in the claims.

BRIEF DESCRIPTION OF THE DRAWING

FIG. 12(*b*) is a perspective view showing the state of user of the eraser when correcting a part of curve such as graphic pattern.

FIG. 13(*b*) is a perspective view showing the assembled state of the base end support portion of the coat film transfer head and the head holding portion of the support board of the same.

FIG. 13(*c*) is a front sectional view showing the assembled state of the base end support portion of the coat film transfer head and the head holding portion of the support board of the same.

FIG. 14(*b*) is a perspective view showing the assembled state of the base end support portion of the coat film transfer head and the head holding portion of the support board of the same.

FIG. 14(*c*) is a front sectional view showing the assembled state of the base end support portion of the coat film transfer head and the head holding portion of the support board of the same.

FIG. 15(*b*) is a perspective view showing the assembled state of the base end support portion of the coat film transfer head and the head holding portion of the support board of the same.

FIG. 15(*c*) is a front sectional view showing the assembled state of the base end support portion of the coat film transfer head and the head holding portion of the support board of the same.

FIG. 16(*b*) is a perspective view showing the assembled state of the base end support portion of the coat film transfer head and the head holding portion of the support board of the same.

FIG. 16(*c*) is a front sectional view showing the assembled state of the base end support portion of the coat film transfer head and the head holding portion of the support board of the same.

FIG. 17(*b*) is a perspective view showing the assembled state of the base end support portion of the coat film transfer head and the head holding portion of the support board of the same.

FIG. 17(*c*) is a front sectional view showing the assembled state of the base end support portion of the coat film transfer head and the head holding portion of the support board of the same.

FIG. 18(*b*) is a perspective view showing an engaging and supporting member at the feed reel side position in the eraser in embodiment 7 of the invention.

FIG. 22(*b*) is a perspective view showing an engaging and supporting member of the feed reel side position of the same.

FIG. 24(*b*) is a perspective view showing a feed rotary gear of the feed reel side position of the same.

FIG. 25(*b*) is a perspective view showing the eraser by opening the case.

DETAILED DESCRIPTION OF THE PREFERRED EMBODIMENTS

Figure 1:
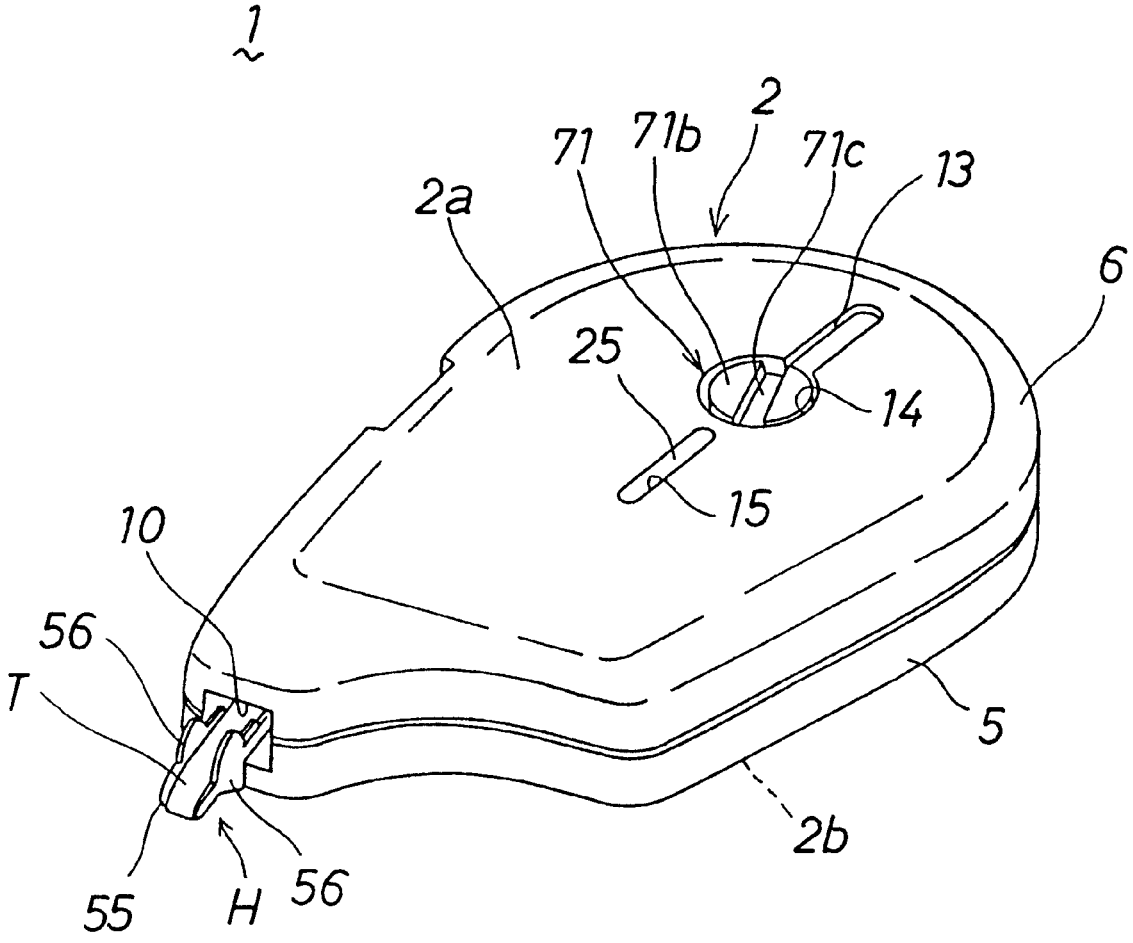
FIG. 1 is a perspective view showing an eraser in embodiment 1 of the invention.

Referring now to the drawings, preferred embodiments of the invention are described below.

FIG. 1 through FIG. 31 show the tape cartridge and coat film transfer tool according to the invention, and same reference numerals given throughout the drawings refer to same constituent members or elements.

Embodiment 1

A coat film transfer tool according to the invention is shown in FIG. 1 to FIG. 12. This coat film transfer tool 1 is specifically designed to be used as an eraser for correcting wrong letters and the like, and is of horizontal drawing type having a cartridge or refill type structure enabling to replace the coat film transfer tape T as consumable part.

Figure 3:
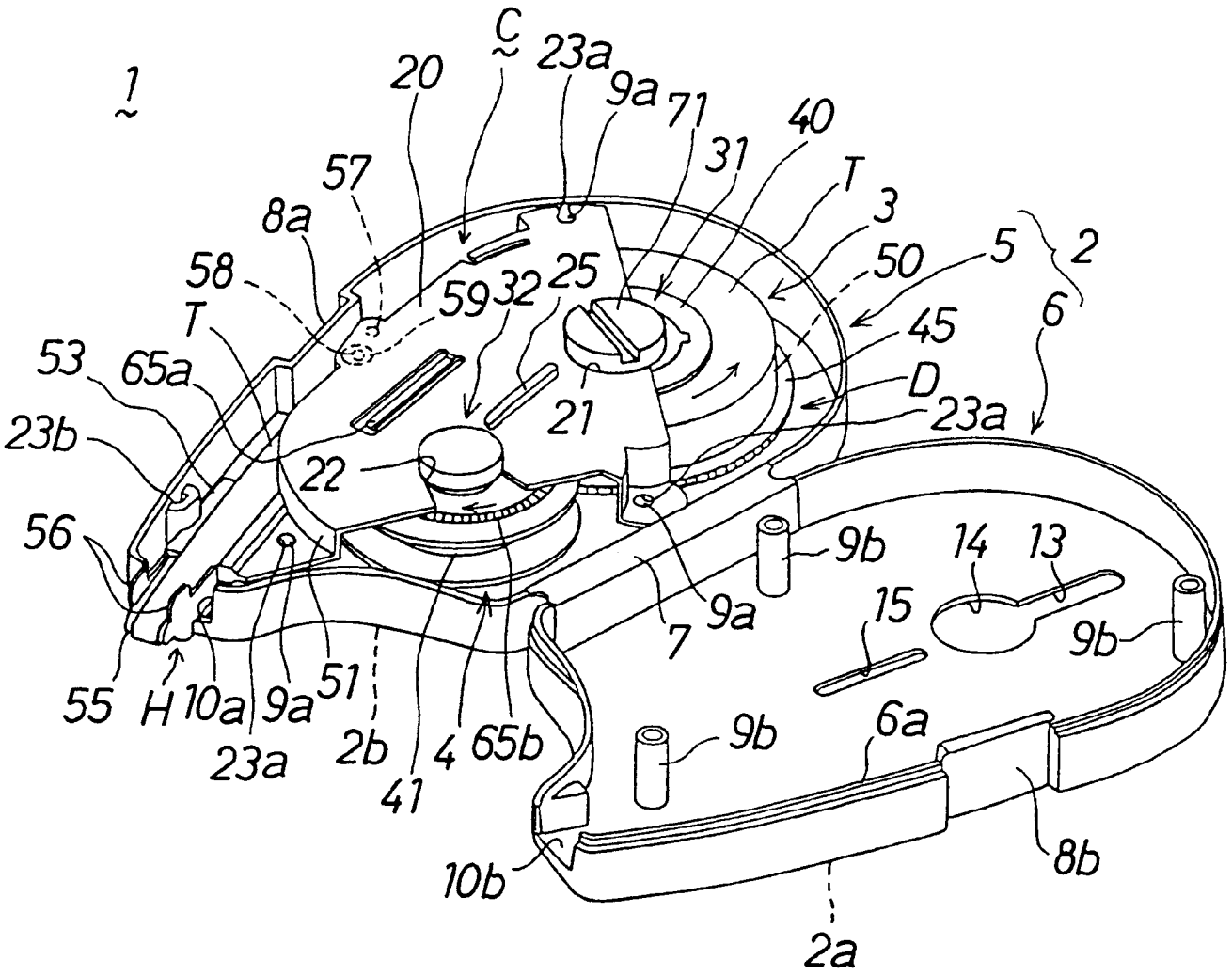
FIG. 3 is a perspective view showing the inside of the eraser by opening the case.
Figure 4:
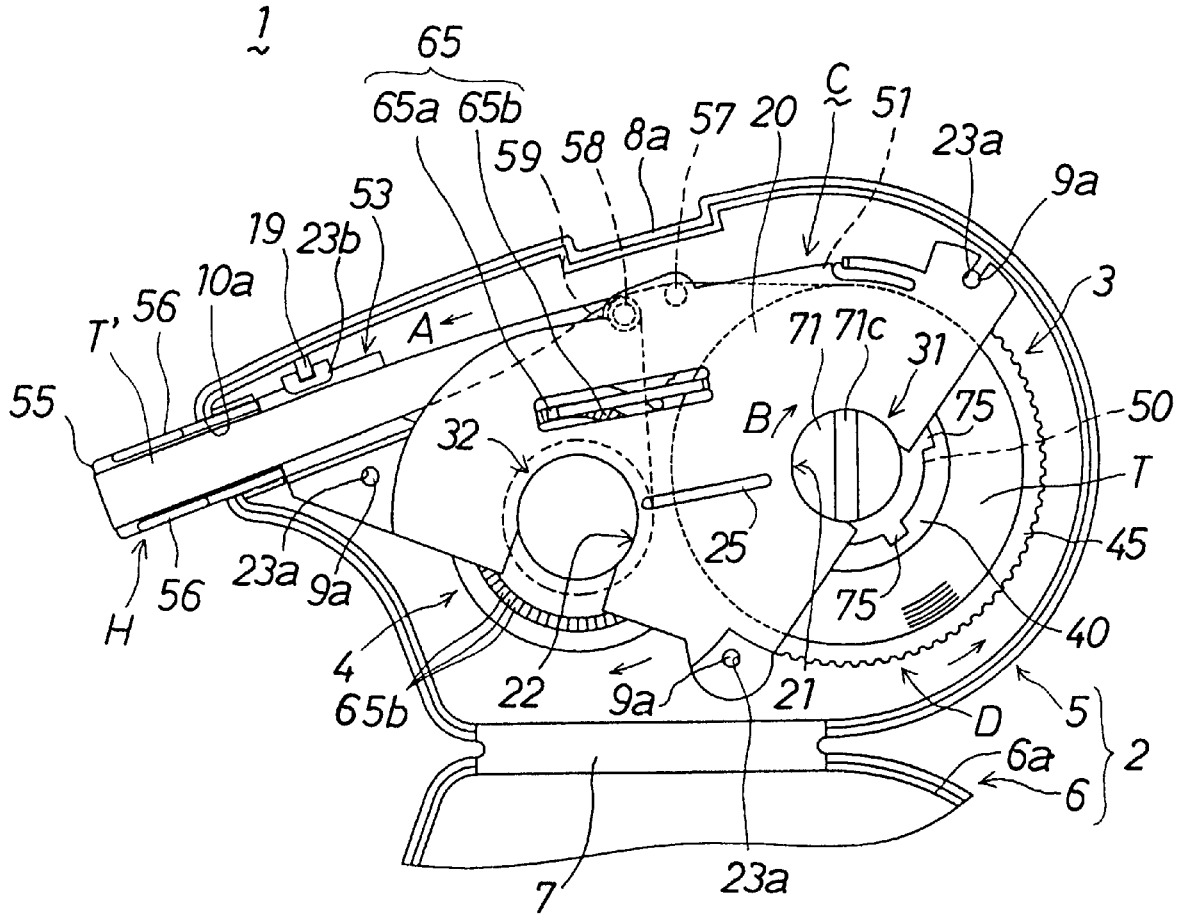
FIG. 4 is a front view showing the inside of the case main body of the eraser.

The coat film transfer tool 1 comprises a tape cartridge C having a coat film transfer head H and a tape interlocking unit (interlock mechanism) D as shown in FIG. 3 and FIG. 4 installed a case 2 having an appearance and shape as shown in FIG. 1. The coat film transfer tool 1 has a two-axis type reel structure having a feed reel 3 and a take-up reel 4 supported independently on the cartridge C. Each component is described below.

I. Case 2

The case 2 is a flat box having a front contour shape and dimension and width enough for incorporating the tape cartridge C and the tape interlocking unit D, and, as mentioned below, a pair of flat face and back side 2*a*, 2*b* of the case 2 are gripping surfaces to be held and manipulated by hand as described below.

This case 2 is a plastic piece integrally formed by injection molding or the like. The case 2 has a case main body 5 and a cap body 6 that can be opened and closed, and the tape cartridge C and tape interlocking unit (interlock mechanism) D are mounted on the case main body 5.

The case main body 5 and the cap body 6 are connected to be oscillatable mutually by a hinge 7 as shown in FIG. 3, and repulsive engaging portions 8*a*, 8*b* are provided at the case main body 5 at the opposite side of the hinge 7 and the opening of the cap body 6. At the opening inner peripheral edge of the cap body 6, a fitting flange 6*a* to be fitted to the opening inner peripheral edge of the case main body 5 is provided almost on the entire circumference, and at the inner side of the case main body 5 and cap body 6, three pairs of positioning fitting portions 9*a*, 9*b* are disposed oppositely to each other.

At the leading end of the case main body 5 and cap body 6, inserting grooves 10*a*, 10*b* for forming a head inserting portion 10 inserting inside and outside of a coat film transfer head H are cut and formed, and hollow rotary support shafts 11, 12 for rotating and supporting the feed reel 3 and take-up reel 4 of the tape cartridge C are integrally provided at the inner side of the case main body 5.

By oscillating and stopping the cap body 6 on the case main body 5 at the hinge 7, the fitting flange 6*a* is fitted to the opening inner peripheral edge of the case main body 5, and the three pairs of positioning fitting portions 9*a*, 9*b* are fitted to each other. The repulsive engaging portions 8*a*, 8*b* are mutually engaged repulsively, and the case 2 is closed and formed. The positioning fitting portion 9*a* is in a form of positioning pin, and the positioning fitting portion 9*b* is in a form of positioning recess to be engaged with this positioning pin 9*a*. These both positioning fitting portions 9*a*, 9*b* also function as positioning means for a support board 20 mentioned below.

On the other hand, by the completely reverse manipulation, the case 2 is opened into the case main body 5 and the cap body 6. When closing and forming the case 2, a nearly rectangular head inserting portion 10 is opened and formed at its leading end. This head inserting portion 10 functions also as the rotating angle defining portion for defining the rotating angle of the coat film transfer head H as mentioned later.

In the cap body 6, moreover, a remainder checking window 13 for checking the remainder of the coat film transfer tape T and an opening 14 for a rewind button 71 mentioned later are opened continuously, and a slit 15 for a handling knob 25 of the tape cartridge C mentioned later is also opened.

II. Tape cartridge C

The tape cartridge C is a constituent part replaceable as a consumable part, and its specific structure is shown in FIG. 2 to FIG. 9.

In this tape cartridge C, a feed reel 3 winding a coat film transfer tape T and a rotatable take-up reel 4 for recovering the coat film transfer tape T' after use are rotatably mounted on a flat support board 20, and a coat film transfer head H for pressing the coat film transfer tape T onto the transfer area is rotatably mounted about its head axis. The tape cartridge C is detachably mounted on the case main body 5 as shown in FIG. 2 to FIG. 5.

The flat support board 20 is a plastic plate integrally formed by injection molding or the like, and its shape and dimensions are set as thin and compact as possible in a range of accommodating the holding function of the both reels 3, 4 and coat film transfer head H.

In the illustrated embodiment, the flat shape of the support board 20 is a nearly inverted triangular shape as shown in FIG. 4, and in its both lower oblique sides, bearings 21, 22 for supporting the feed reel 3 and take-up reel 4 are provided, and at its upper leading end portion, a head holding portion 53 for holding the coat film transfer head H is integrally provided.

At three vertices of the support board 20, positioning engaging portions 23*a*, 23*a*, 23*a* are provided, and these positioning engaging portions 23*a* . . . are formed as engaging holes to be engaged with the three pairs of positioning fitting portions 9*a*, 9*b*, . . . provided corresponding to the inner side of the case 5, and in collaboration with these three pairs of positioning fitting positions 9*a*, 9*b*, . . . , the positioning means for the support board 20 is composed. At the side of the head holding portion 53, a head positioning engaging portion 23*b* is provided, and a head positioning portion 19 is provided in the case body 5 as a corresponding part.

The longitudinal dimension of the support board 20, that is, the upper bottom side length of the inverted triangular shape is nearly in the same size as the maximum layout dimension of the both reels 3, 4, and its vertical width dimension, that is, the height dimension of the inverted triangular shape is set nearly same as the maximum outside diameter of the feed reel 3. Reference numeral 25 is a handling knob of linear rib form formed integrally on the outer surface of the support board 20.

The support board 20 is formed in a structure for rotatably supporting the end portions 31*a*, 32*a* at the upper side ends of the rotary shafts 31, 32 of the both reels 3, 4, that is, at the opposite sides of the sides supported by the rotary support shafts 11, 12 of the case main body 5.

In a specific rotary support structure of the both reels 3, 4 in this support board 20, the bearings 21, 22 are formed on the support board 20, and annular engaging grooves 37, 38 are formed on the entire circumference of the upper end portions 31*a*, 32*a* of the rotary shafts 31, 32 of the reels 3, 4, and these annular engaging grooves 37, 38 are rotatably engaged and supported on the bearings 21, 22.

Figure 6:
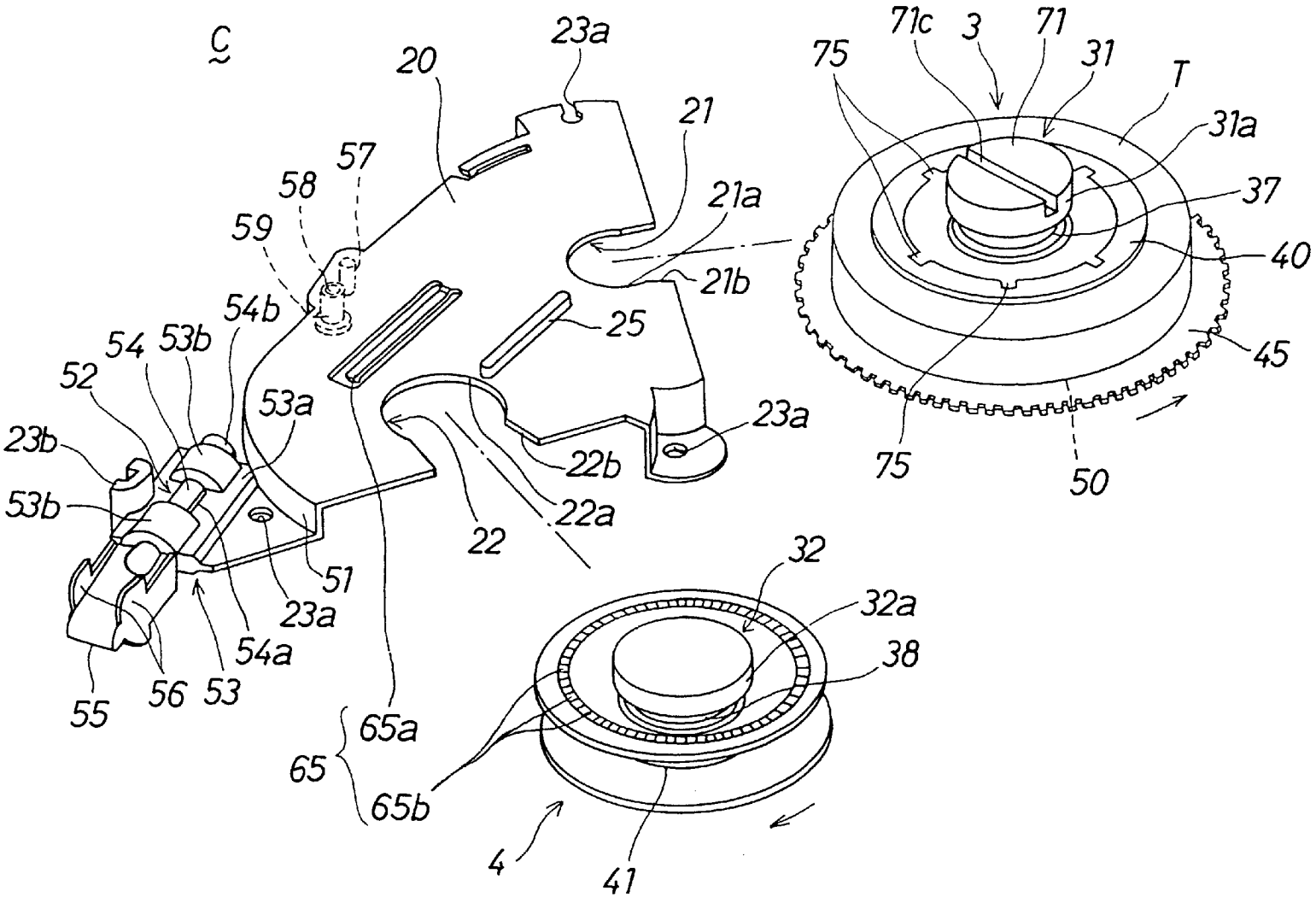
FIG. 6 is a perspective exploded view of a cartridge of the eraser.

In the illustrated embodiment, the bearings 21, 22 are in recess bearing forms opened to the outer edge of the support board 20, that is, to the both lower oblique sides of the flat inverted triangular shape as shown in FIG. 6. The flat shape of the bearings 21, 22 is designed in consideration of ease of assembling at the manufacturing site.

That is, the bearings 21, 22 are formed of circular portions 21*a*, 22*a* having the inside diameter corresponding to the outside diameter of the annular engaging grooves 37, 38, and mounting inserting portions 21*b*, 22*b* expanding in a taper form from these circular portions 21*a*, 22*a* toward the outer periphery of the support board 20.

Figure 5:
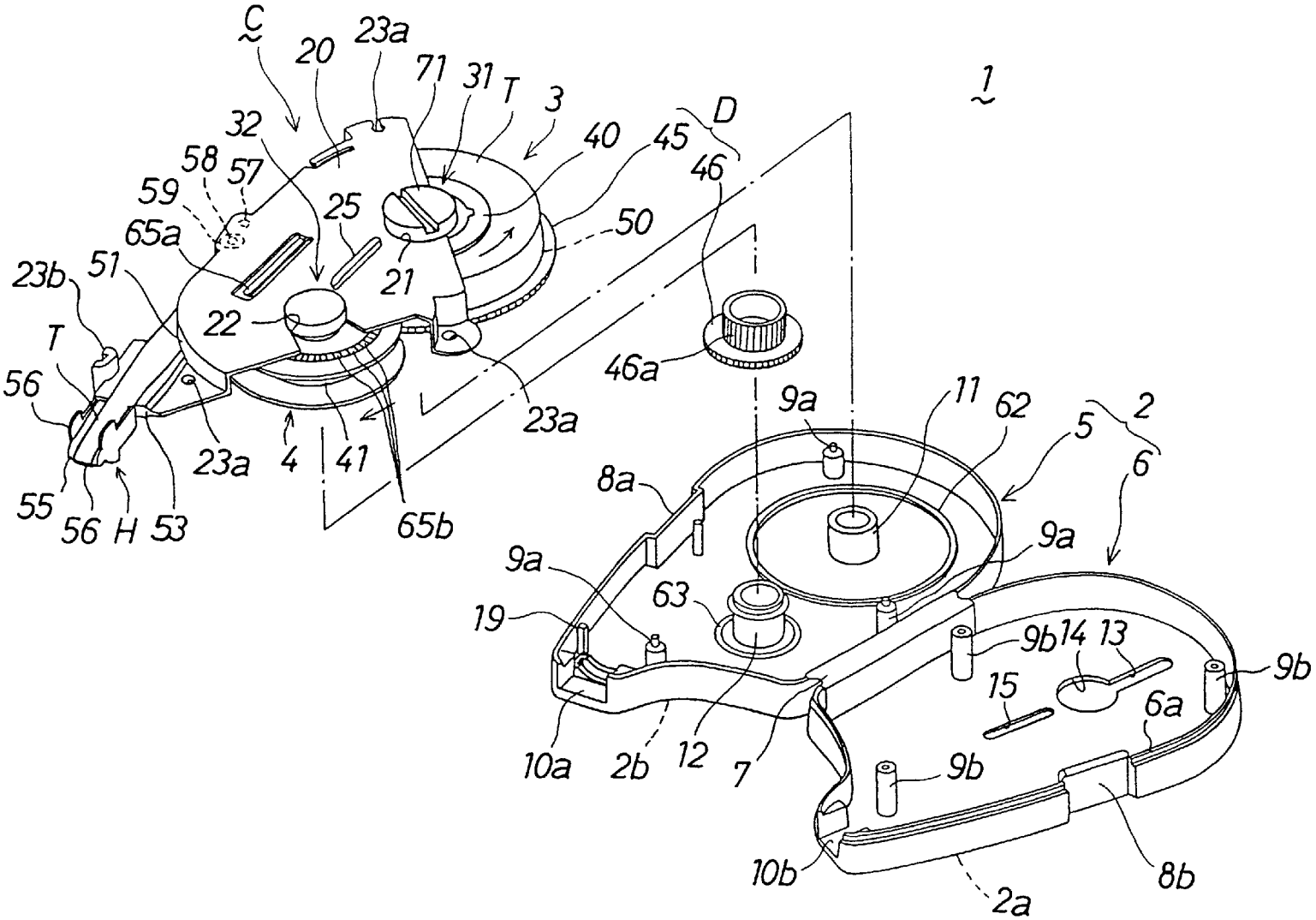
FIG. 5 is a perspective exploded view of the eraser.

The circular portions 21*a*, 22*a* of the bearings 21, 22 are disposed corresponding to the rotary support shafts 11, 12 of the case main body 5, respectively. Accordingly, the layout of the both reels 3, 4 on the support board 20 is as shown in FIG. 4 and FIG. 5, that is, the rotary shafts 31, 32 are set at coaxial positions to the rotary support shafts 11, 12.

The both reels 3, 4 are positioned and supported at specified positions as the annular engaging grooves 37, 38 of the rotary shafts 31, 32 are pressed and inserted by force from the mounting inserting portions 21*b*, 22*b* into the circular portions 21*a*, 22*a*, and the boundary portions of the mounting and inserting portions 21*b*, 22*b* and circular portions 21*a*, 22*a* are elastically expanded and then elastically restored again, so that the annular engaging grooves 37, 38 are rotatably fitted into the circular portions 21*a*, 22*a*, both reels 3, 4 are positioned and supported at specified positions respectively.

As the bearings 21, 22 are disposed near the outer periphery of the support board 20, while the both reels 3, 4 are positioned and supported on the bearings 21, 22, part of the both reels 3, 4 is exposed and disposed outside from the outer periphery of the support board 20. This allows to rotate and manipulate the reels 3, 4 by finger, and when mounting the tape cartridge C on the case main body 5 mentioned later, it enables to rotate and adjust if the feed rotary gear 45 provided at the feed reel 3 side is not engaged accurately with the teeth of the take-up rotary gear 46 provided in the case main body.

In the illustrated embodiment, the bearings 21, 22 are, as shown in FIG. 6, in recess bearing forms opened to the outer edge of the support board 20, that is, to the both lower oblique sides of the flat inverted triangular shape. The flat shape of the bearings 21, 22 is designed in consideration of ease of assembling at the manufacturing site.

The feed reel 3 has a hollow cylindrical tape core 40 on which a new coat film transfer tape T is wound, and also comprises a clutch mechanism 50 cooperating with this tape core 40 and the feed rotary gear 45 of the tape interlocking unit D. The specific mounting structure of this feed reel 3 is described later in relation to the clutch mechanism 50.

The take-up reel 4 is to take up and recover the coat film transfer tape T' after use, and the leading end portion of the coat film transfer tape T is connected to the outer circumference of the hollow cylindrical tape core 41.

The tape core 41 also serves as part of the rotary shaft 32 of the take-up reel 4, and its axial upper end portion is formed coaxially and integrally with the upper end portion 32*a,* and this upper end portion 32*a* is rotatably supported to the support board 20. On the other hand, in the center of the tape core 41 (32), a mounting hole 41*a* having a serration or spline tooth profile engaging portion is provided, and is integrally engaged with the rotary shaft portion 46*a* of the take-up rotary gear 46 of the tape interlocking unit D mentioned later detachably and in the rotating direction.

The coat film transfer tape T is manufactured, for example, by using a film base material (thickness about 25 to 38 microns) of plastic film of polyester, acetate or the like, or paper tape, or others, forming a parting agent layer of vinyl chloride-vinyl acetate copolymer resin, low molecular polyethylene, or the like on its one side, forming a white corrective paint layer thereon, and applying an adhesive layer (pressure-sensitive agent) layer of polyurethane or the like having a pressure adhesive property further thereon (specific structure is not shown). The corrective paint layer is of so-called dry type so that it is possible to write on immediately after transfer.

Corresponding to these both reels 3, 4, a tape protective wall 51 is provided along the edge of the upper bottom side of the inverted triangular shape of the support board 20. This protective wall 51 is a plate having same thickness as the support board 20, and is formed upside down and integrally along the peripheral edge of the support board 20 so as to cover the outer circumference of the feed reel 3 and take-up reel 4, more specifically the outer circumference of the coat film transfer tape T wound thereon.

The coat film transfer head H is to press the coat film transfer tape T onto the correction area of wrong letter or the like on the sheet of paper (transfer area), and has a guiding function and a pressing function of the coat film transfer tape T.

More specifically, the coat film transfer head H is a rectangular plate having a certain elasticity, and a base end support part 52 is integrally formed at its base end, and the base end support part 52 is rotatably held on the head holding portion 53 of the support board 20.

Figure 7:
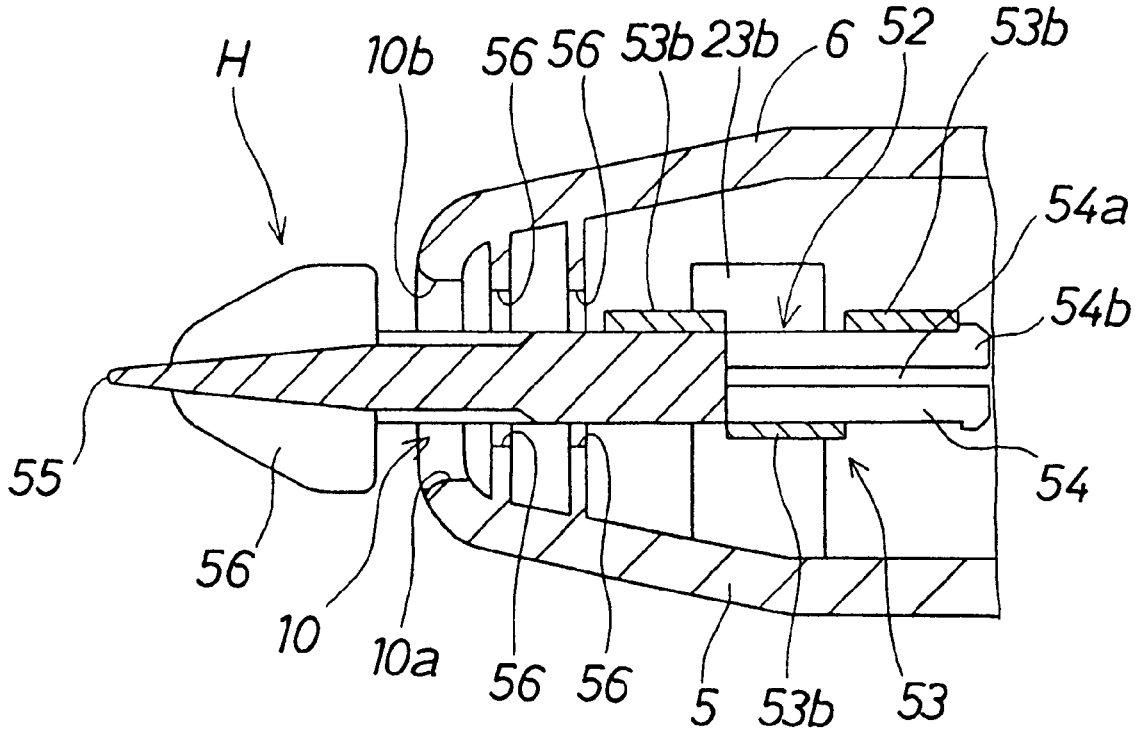
FIG. 7 is a side sectional view showing the rotary support structure of a coat film transfer head of the eraser.

The coat film transfer head H of the illustrated embodiment is a thin plate slightly wider than the coat film transfer tape T as shown in FIG. 4, and has a taper section so as to be gradually thinner toward the leading end as shown in FIG. 7, and its both flat side surfaces form the tape running surface, and its leading end 55 is a pressurizing portion for pressing the coat film transfer tape T. At both side edges of the head main body H, guide flanges 56, 56 for guiding running of the coat film transfer tape T are formed.

The base end support portion 52 is, as shown in FIG. 6 and FIG. 7, composed of a columnar bar 54 extending linearly from the center at the base end of the coat film transfer head H, that is, the position of the axial center (head axial center) of the head H, backward along the head axial center. This columnar bar 54 is in a split form having a slit 54*a* formed in the center, and an anti-slipping portion 54*b* is formed in its rear end.

In correspondence, the head holding portion 53 of the support board 20 is in a form of holding hole, and more specifically as shown in FIG. 6 and FIG. 7, it is composed of cylindrical inner sides of holding hemi-cylindrical portions 53*b,* 53*b,* 53*b* bulging alternately at the upper and lower sides of the holding main body 53*a,* so that the ease of molding is assured.

Then, as shown in FIG. 7, the columnar bar 54 of the coat film transfer head H penetrates into the head holding portion of the support board 20 (holding semi-cylindrical portions 53*b,* 53*b,* 53*b*) from the front side, and a stopping portion 54*b* is hooked on the rear end of the head holding portion 53. In this case, the columnar bar 54 is shortened in diameter because of the presence of the slit 54*a,* thereby allowing insertion of the anti-slipping portion 54*b* at the rear end into the head holding portion 53, and after insertion, the columnar bar 54 is elastically restored, and the stopping portion 54*b* is stopped and hooked on the rear end of the head holding portion 53. As a result, the coat film transfer head H is supported on the head holding portion 53 of the support board 20, rotatably about the head axial center.

The head inserting portion 10 of the case 2 functions also as the rotating angle defining portion for defining the rotating angle of the coat film transfer head H, in addition to the intrinsic function of inserting the coat film transfer head H inside and outside.

The constitution of the head inserting portion 10 as the rotating angle defining portion is specifically shown in Pig. 9, in which the front side of the head insertion portion 10 is a rectangular shape, and its vertical dimension h and lateral dimension w are determined in relation to the rotation contour diameter dimension of the coat film transfer head H.

In the illustrated embodiment, the vertical dimension h of the head insertion portion 10 is set nearly same as but slightly smaller than the rotation contour diameter dimension of the coat film transfer head H, and the lateral dimension w is set smaller than the rotation contour diameter dimension of the coat film transfer head H.

Accordingly, the leading end pressurizing portion 55 sets the coat film transfer tape T nearly opposite to the gripping surfaces 2*a,* 2*b* of the case 2, that is, the coat film transfer head H can rotate only in a range of a specified angle θ in both directions (in the illustrated embodiment, θ is nearly 43 degrees, and the total of both directions is nearly 86 degrees), from the angle position X (horizontal position indicated by solid line in FIG. 8) for guiding the coat film transfer tape T so that the face and back sides of the coat film transfer tape T may be almost in the same direction (parallel) as the gripping surfaces 2*a,* 2*b.*

This rotating angle range (2θ) can be set in a desired value by setting the front shape dimension of the head insertion portion 10 depending on the purpose, and it can be set properly, for example, from a small angle range of θ of 10 degrees or less to a large angle range of θ of 80 degrees or more.

Figure 8:
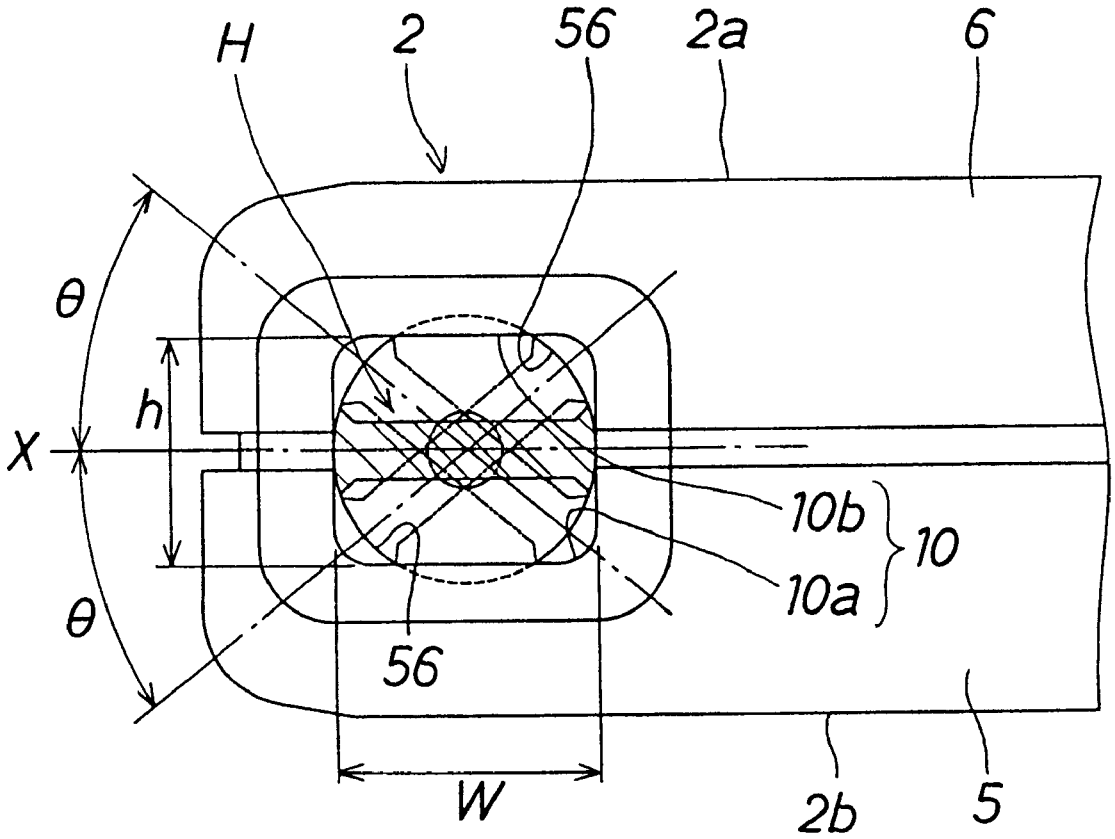
FIG. 8 is a magnified front view explaining the rotating direction operation of the coat film transfer head of the eraser.

In correspondence, as shown in FIG. 8, at the rear side position of the head insertion portion 10 in the case main body 5, rotation support ribs 56, 56 having circular edges corresponding to the rotation contour circle of the coat film transfer head H are provided, and they guide and hold smoothly the rotation motion of the coat film transfer head H.

The coat film transfer tape T propelled from the feed reel 3 is, as shown in FIG. 5, guided into the leading end pressurizing portion 55 along the tape running surface of one side of the coat film transfer head H, and is inverted from this leading end pressurizing portion 55, and is further guided along the tape running surface of opposite side, and is taken up on the take-up reel 4.

In this case, as mentioned above, the leading end pressurizing portion 55 of the coat film transfer head H cooperates with the tape running surface at the side surface of the head, and sets the coat film transfer tape T almost oppositely to the gripping surfaces 2*a*, 2*b* of the case 2, that is, guides the coat film transfer tape T so that the face and back sides of the coat film transfer tape T may be almost in same direction (parallel) as the gripping surfaces 2*a*, 2*b*.

In relation to the configuration of the coat film transfer head H and both reels 3, 4, between the both reels 3, 4 and the coat film transfer head H on the support board 20, a pair of guide pins 57, 58 are provided, and these guide pins 57, 58 function as tape position converting means for converting the running position of the coat film transfer tape T.

One guide pin 57 is to change the position of the coat film transfer tape T propelled from the feed reel 3 and guide into the coat film transfer head H, and is provided upright and integrally at a proper position at the back side of the support board 20 between the feed reel 3 and the coat film transfer head H. Other guide pin 58 is to change position of the coat film transfer tape T' after use from the coat film transfer head H, and guide into the take-up reel 4, and is provided upright and integrally at a proper position at the back side of the support board 20 between the coat film transfer head H and the take-up reel 4.

In this structure of the both guide pins 57, 58 provided on the support board 20, all setting of the tape T is complete in the stage of product, and the general use has only to replace the tape cartridge C, which is a great advantage.

Moreover, on the take-up side guide pin 58, a flanged guide roller 59 is rotatably supported. In such structure, smooth and neat take-up guiding of the coat film transfer tape T' is encouraged, and if the coat film is left over on the coat film transfer tape T due to defective transfer, the trouble of inclusion of this coat film transfer tape T' into the guide pin 58 can be securely prevented. The feed side guide roller 57 may be also provided with a similar guide roller.

III. Tape interlocking unit D

The tape interlocking unit (interlock mechanism) D is to interlock the feed reel 3 and take-up reel 4 mutually, and more specifically it is composed of a feed rotary gear 45 (interlock gear) provided at the feed reel 3 side and a take-up rotary gear 46 (interlock gear) provided at the take-up reel 4 side.

Figure 2:
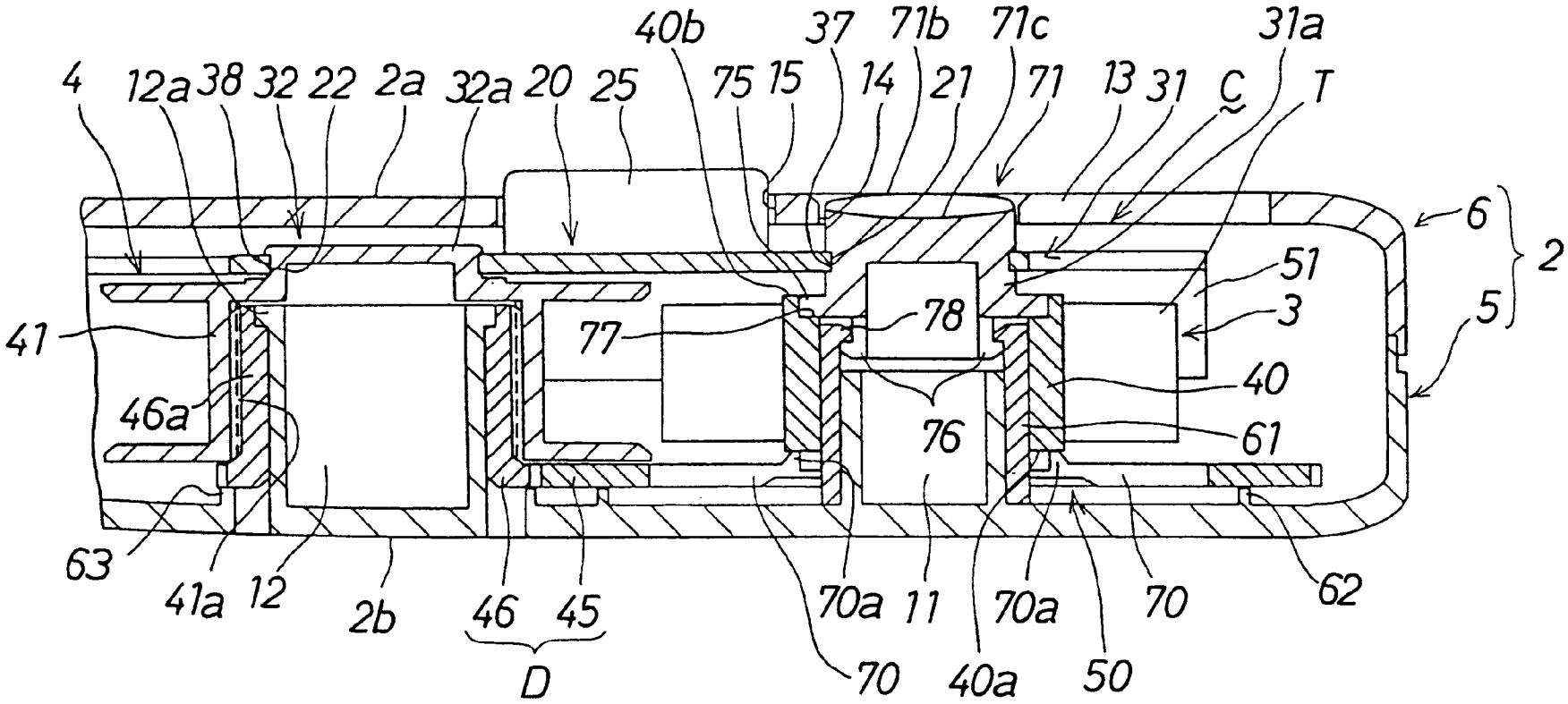
FIG. 2 is a side sectional view showing the principal internal parts of the eraser.

The feed rotary gear 45 is formed integrally with a rotary drive unit 61 of clutch mechanism 50 provided on the feed reel 3, and the rotary drive unit 61 also functions as the rotary shaft of the feed rotary gear 45. This rotary drive unit 61 has a hollow cylindrical form, and is detachably and rotatably supported on the rotary support shaft 11 of the case main body 5. In this case, the lower end face in the axial direction of the rotary drive unit 61 is oscillatably supported at the inner side of the case main body 5 as shown in FIG. 2. Reference numeral 62 is an annular rib provided at the inner side of the case main body 5, and this annular rib 62 is disposed corresponding to the outer circumference of the feed rotary gear 45 concentrically with the rotary support shaft 11, and oscillatably supports the lower side of the feed rotary gear 45 to prevent excessive distortion or the like of the feed rotary gear 45.

On the outer circumference of the rotary drive unit 61, the tape core 40 of the feed reel 3 is coaxially and rotatably supported, and this tape core 40 and the feed rotary gear 45 are frictionally engaged with each other by engaging protrusions 70, 70, . . . which are frictional engaging members of the clutch mechanism 50 mentioned later.

The take-up rotary gear 46 is rotatably supported on the rotary support shaft 12 of the case main body 5 for supporting the take-up reel 4, and is engaged with the feed rotary gear 45 assembled as a unit together with the feed reel 3 on the support board 20. At the leading end of the rotary support shaft 12, an anti-slipping portion 12*a* is provided for preventing slipping of the take-up rotary gear 46.

At the inner side of the case main body 5, an annular 31. rib 63 is provided concentrically with the rotary support shaft 12 and corresponding to the take-up rotary gear 46, and the take-up rotary gear 46 is oscillatably supported on this annular rib 63.

The take-up rotary gear 46 is engaged with the feed rotary gear 45 at a specific gear ratio, so that the take-up rotary gear 46 rotates in cooperation with the feed rotary gear 45 always at a specific rotation ratio. This rotation ratio, that is, the gear ratio of the two gears 45, 46 is set properly so that the coat film transfer tape T may be propelled and taken up smoothly in consideration of the take-up diameter of the coat film transfer tape T on the feed reel 3 and take-up reel 4 as mentioned later.

In relation thereto, as shown in FIG. 3 to FIG. 6, the support board 20 and the tape core 41 of the take-up reel 4 are provided with a reverse rotation preventive mechanism 65 for preventing reverse rotation of the both reels 3, 4. This reverse rotation preventive mechanism 65 comprises, as shown in FIG. 4 and FIG. 6, an elastic detent claw 65*a* provided deformably on the support board 20, and multiple reverse rotation preventive claws 65*b*, 65*b*, . . . provided concentrically with the rotary shaft 32 in an annular form at the outer side of the flange 41*a* of the tape core 41.

In this constitution, as the both reels 3, 4 are about to move in the arrow direction, the detent claw 65*a* rides over the reverse rotation preventive claws 65*b*, 65*b*, . . . while deforming elastically, and allows the normal rotation. On the other hand, when the both reels 3, 4 are about to rotate in the opposite direction of the arrow direction, the detent claw 65*a* is engaged with any one of the reverse rotation preventive claws 65*b*, 65*b*, . . . , and arrests the reverse rotation.

This reverse rotation preventive mechanism 65 may be provided between the case main body 5 and the take-up rotary gear 46, or feed rotary gear 45.

IV. Clutch mechanism 50

The clutch mechanism 50 is designed to synchronize the feed speed and take-up speed of the coat film transfer tape T at the feed reel 3 and take-up reel 4, and is specifically provided at the feed reel 3 side.

The clutch mechanism 50 of the embodiment is assembled into the tape cartridge C together with the feed reel 3 and the feed rotary gear 45 of the tape interlocking unit D, and is a replaceable consumable part same as the coat film transfer tape T. For this purpose, the specific structure of the clutch mechanism 50 is simple and inexpensive as described below.

Figure 9:
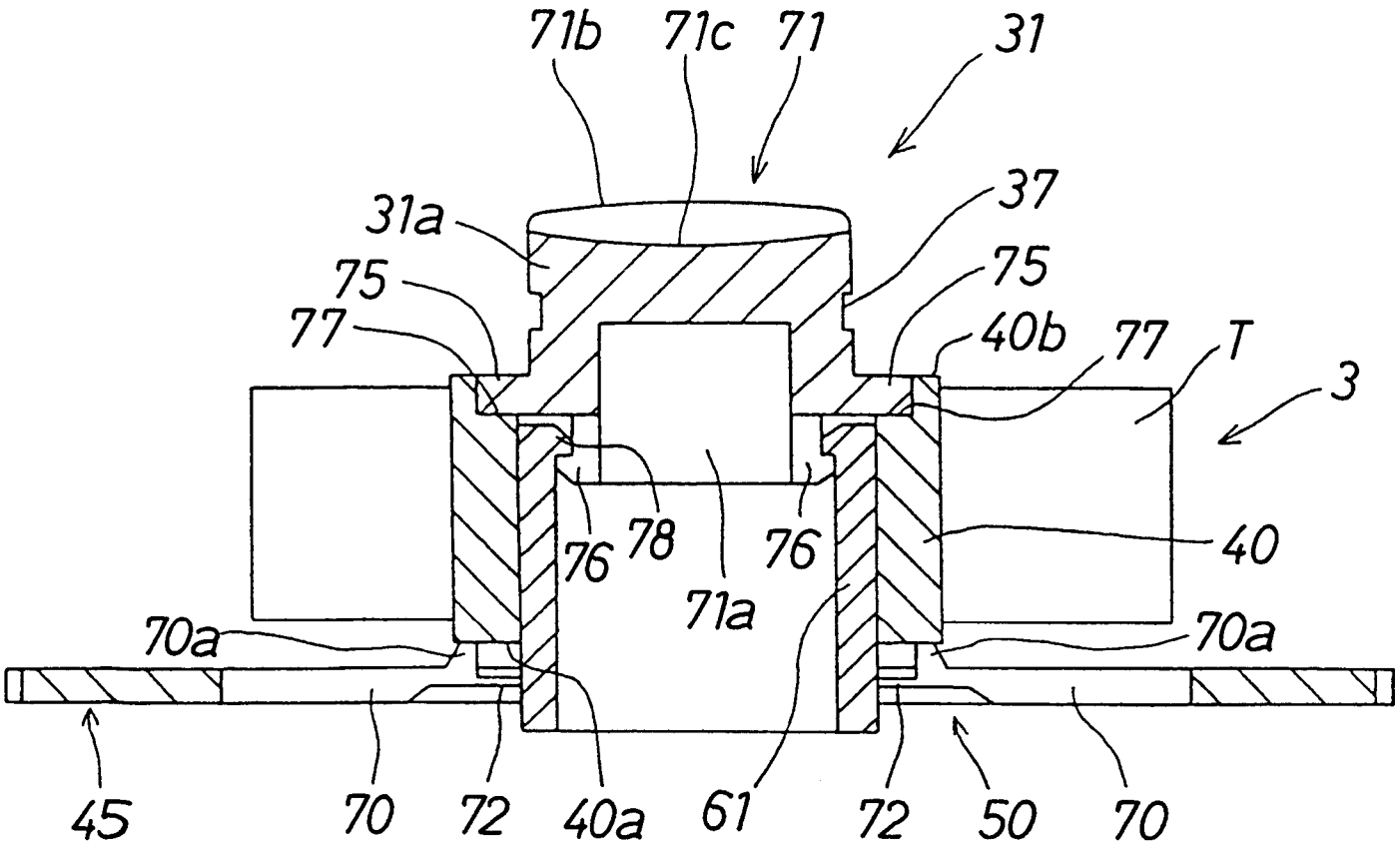
FIG. 9 is a front sectional view showing the feed reel side position of the tape cartridge of the eraser.
Figure 10:
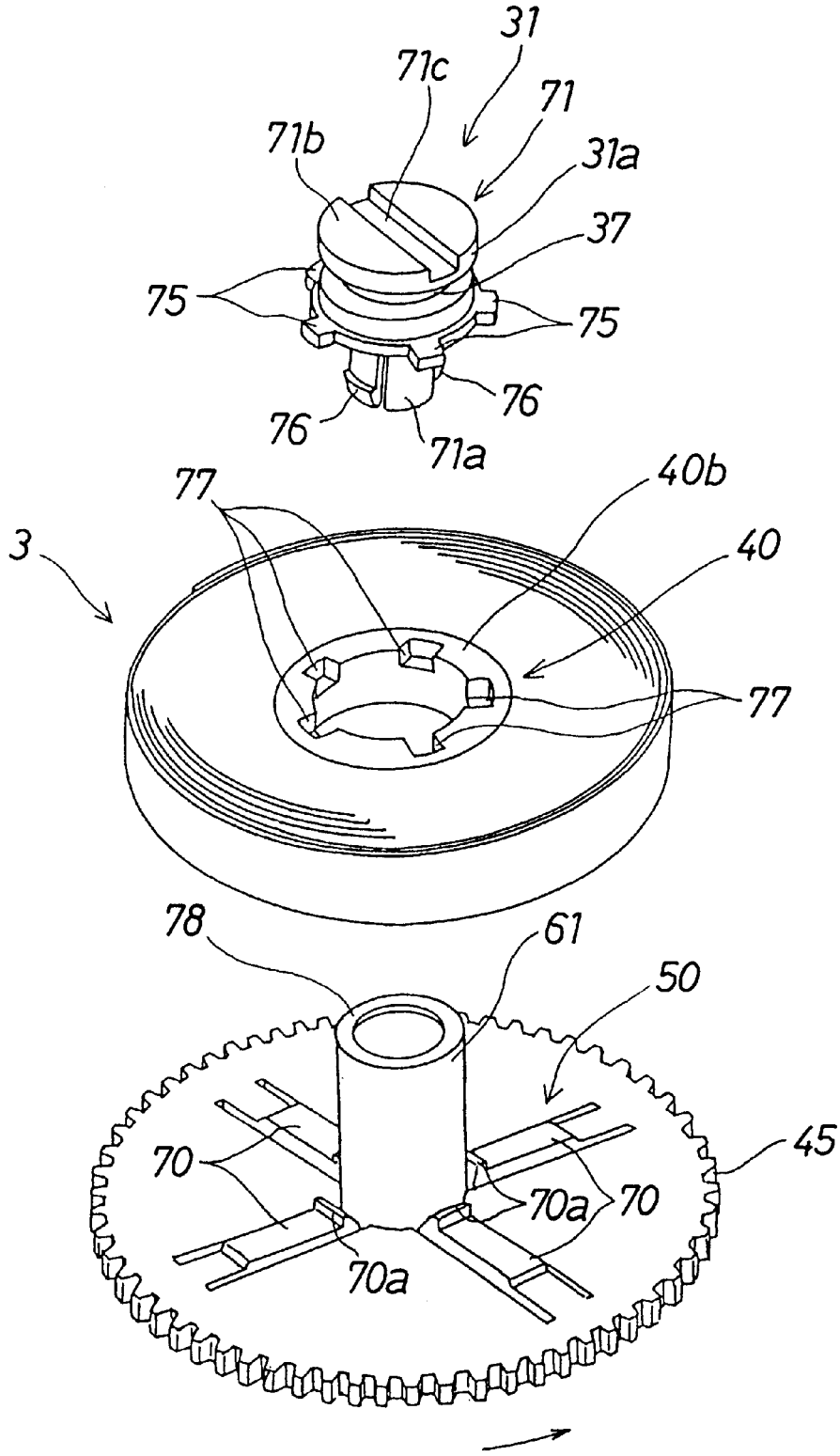
FIG. 10 is a perspective exploded view of the feed reel side position.
Figure 11A:
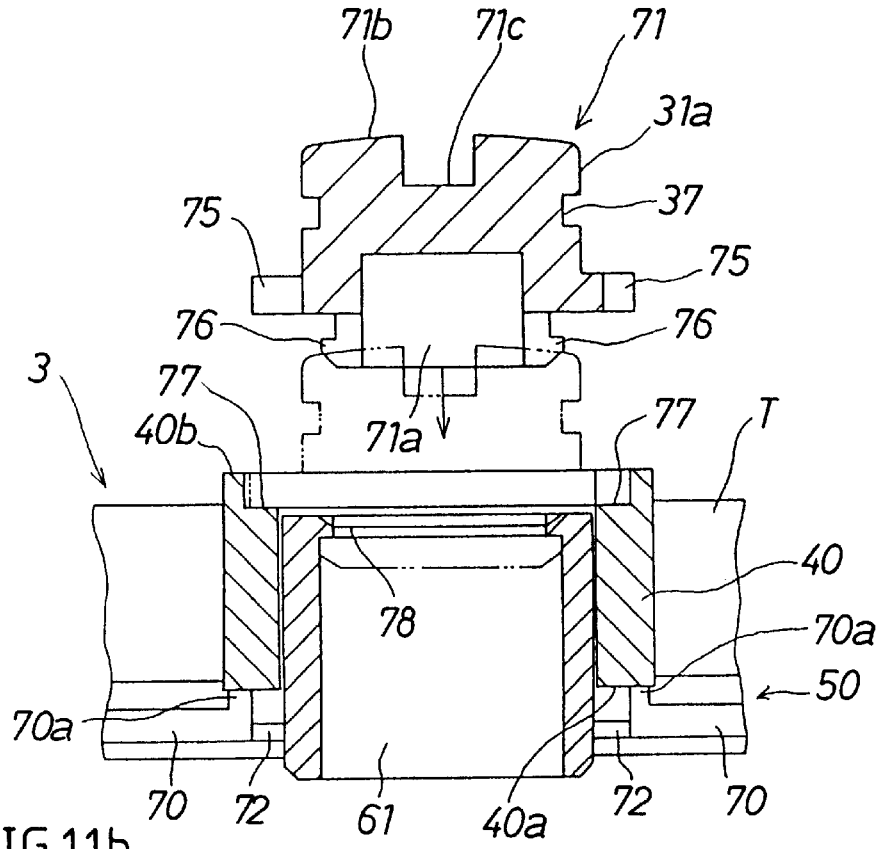
FIG. 11*a* and 11*b* are front sectional view explaining the assembling procedure of the feed reel side position.
Figure 11B:
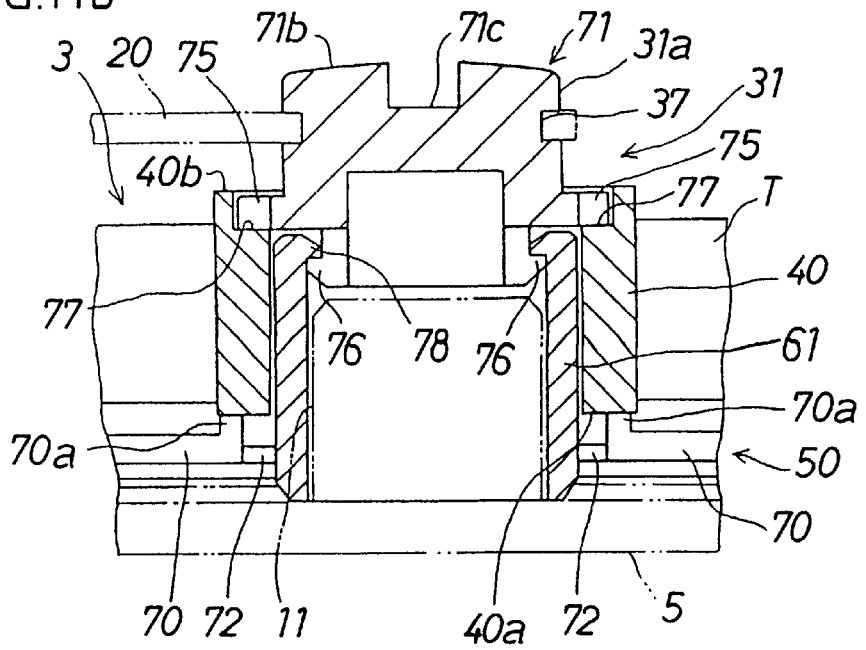

That is, the specific structure of the clutch mechanism 50 is shown in FIG. 9 to FIG. 11, and mainly comprises plural engaging protrusions 70, 70, . . . integrally formed on the feed rotary gear 45, and an engaging support member 71.

The engaging protrusions 70 function as frictional engaging members for composing the power transmitting means in the clutch mechanism 50, and are formed integrally, extending inside in the radial direction, at plural positions (four positions in the illustrated example) in the circumferential direction of the feed rotary gear 45. The engaging protrusions 70 can be elastically deformed in the axial direction from the base end of the outer circumferential side, and have engaging portions 70*a* bulging upward at the inner circumferential side leading end portions. In the illustrated example, the inner circumferential side leading end portions of the engaging protrusions 70 are integrally connected and supported to the rotary drive unit 61 by means of a reinforcing thin connection piece 72.

The engaging portions 70*a* of the engaging protrusions 70 are provided to project upward from the upper side of the feed rotary gear 45 in ordinary state at the position confronting the axial end face 40*a* of the tape core 40, and have engaging flat planes corresponding to the flat plane of the axial end face 40*a*.

The engaging support member 71 is specifically a rewind button, and functions also as a constituent member of tape rewinding mechanism for clearing and removing slack of coat film transfer tape T between the both reels 3, 4.

This rewind button 71 includes an axial engaging portion 75 to be engaged with the axial end face 40*b* of the tape core 40, and a detent claw 76 to be engaged with the rotary drive unit 61.

The axial engaging portion 75 is an engaging bump projecting horizontally in the radial direction from the outer circumference of the rewind button 71, and functions also as the rotary engaging portion of the tape rewinding mechanism, and in the illustrated example, five pieces are provided at equal intervals in the circumferential direction. In correspondence, at the axial end face 40*b* of the tape core 40, five engaging recesses 77 to be engaged with the axial engaging portions 75 are provided at equal intervals in the circumferential direction.

The detent claw 76 is has a vertical slit formed in part of the mounting cylindrical part 71*a* of the rewind button 71, and its leading end engaging portion is elastically deformed in the radial direction. In the illustrated example, a pair of detent claws 76, 76 are provided oppositely on one diameter line of the mounting cylindrical portion 71*a*, and the leading end engaging portion of the detent claw 76 is formed in a downward wedge form.

In correspondence, in the inner circumference of the rotary drive unit 61, there is an engaging flange 78 to be engaged with the detent claw 76 in the axial direction. The inside diameter of this engaging flange 78 is set in a proper size for allowing insertion of the mounting cylindrical portion 71*a* of the rewind button 71, and capable of preventing slipping of the engaging leading end portion of the detent claw 76.

Therefore, after inserting the tape core 40 of the feed reel 3 into the rotary drive unit 61, the rewind button 71 is inserted into the rotary drive unit 61 of the feed rotary gear 45 so that the axial engaging potions 75, 75, . . . may correspond to the engaging recesses 77, 77, . . . of the tape core 40. As a result, the detent claws 76, 76 of the rewind button 71 are elastically deformed to the inner side in the radial direction relatively to the engaging flange 78 of the rotary drive unit 61, and pass in the axial direction, and are then restored elastically so as to be engaged with the engaging flange 78 without slipping out (FIG. 11(*a*) to FIG. 11(*b*)).

Consequently, the tape core 40 is held and supported from both sides in the axial direction by the engaging protrusions 70, 70, . . . of the feed rotary gear 45, and the axial engaging portions 75, 75, . . . of the rewind button 71, and at the same time by the axial engaging force of the rotary drive unit 61 and rewind button 71, the engaging protrusions 70, 70, . . . of the feed rotary gear 45 are elastically and frictionally engaged with the axial end face 40*a* of the tape core 40 in the rotating direction with a specified pressing force.

That is, power transmission of the clutch mechanism 50 makes use of the frictional engaging force by the thrust load acting between the axial end face 40*a* of the tape core 40 and the engaging protrusions 70, 70, . . . of the feed rotary gear 45, and this frictional engaging force is set at an optimum value by properly adjusting the engaging dimensional relation in the axial direction between the rotary drive unit 61 and rewind button 71.

More specifically, in consideration of the spring constant of the engaging protrusions 70, 70, . . . of the feed rotary gear 45 and the elastic deformation amount, the relative axial configuration is properly adjusted between the tape core 40 by the axial engaging portion 75 and detent claw 76 of the rewind button 71 and the feed rotary gear 45, and the frictional engaging force between the engaging protrusions 70, 70, . . . and axial end face 40*a* of the tape core 40 is set at an optimum value.

When assembling the tape cartridge C, in the first place, the unit parts (FIG. 10) of the feed reel 3, feed rotary gear 45 and rewind button 71 thus constituted are integrally assembled into one unit as shown in FIG. 9 and FIG. 11. Successively, these assembled units 3, 45, 71 and the take-up reel 4 are mounted on the bearings 21, 22 of the support board 20 in the procedure mentioned above. Finally, the coat film transfer tape T propelled from the feed reel 3 is set along the periphery of the coat film transfer head H as mentioned above, and its leading end is connected so as to be wound on the take-up reel 4, thereby completing the tape cartridge C.

Figure 14A:
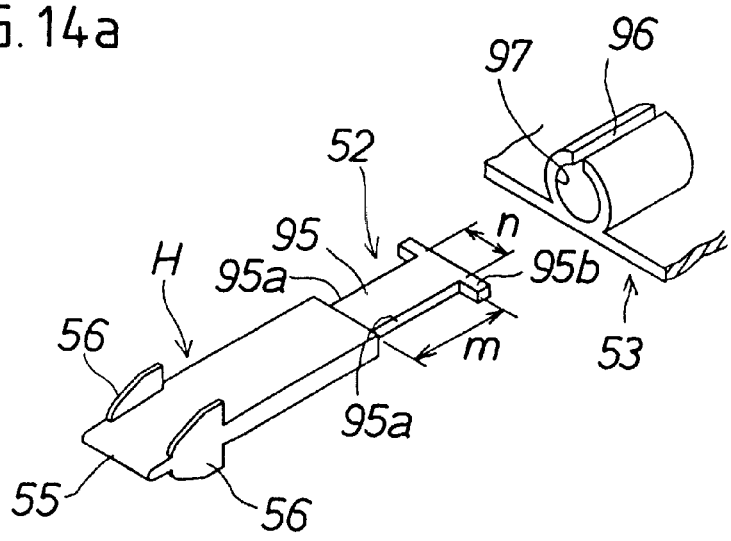
FIG. 14(*a*) is a perspective exploded view of a base end support portion of a coat film transfer head and a head holding portion of a support board, relating to a support structure of the coat film transfer head of a tape cartridge in an eraser in embodiment 3 of the invention.
Figure 14B:
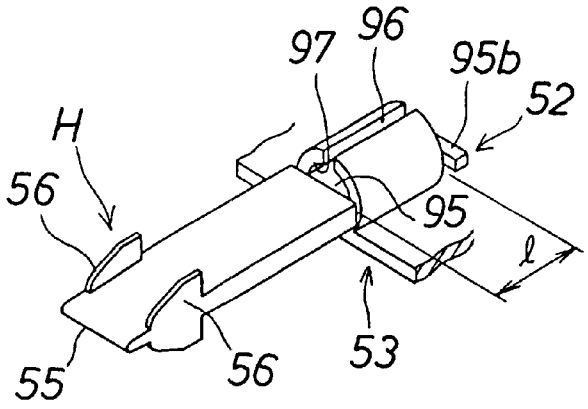
Figure 14C:
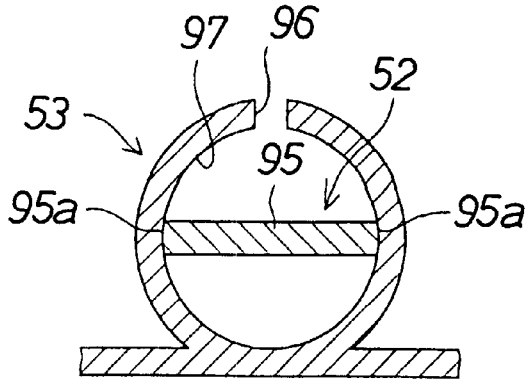

The rewind button 71 is set oppositely to the outside of the case 2 through the opening 14 formed in the cap body 6 of the case 2 as shown in FIG. 1, FIG. 2 and FIG. 14, and is set to be flush with or lower than the surface of the case 2, that is, the gripping surface 2*a* (see FIG. 2). At the outer end face of the rewind button 71, that is, on the outer surface 71*b*, a linear manipulating groove 71*c* is formed as a rotating and manipulating part for rewinding rotary manipulation, and a plating operating member such as a coin is detachably engaged with this manipulating groove 71*c*.

Referring now to FIG. 2 and FIG. 5, in thus constituted tape cartridge C, pinching the handling knob 25 by finger, the feed rotary gear 45 is engaged with the take-up rotary gear 46 mounted on the rotary support shaft 12 of the case main body 5, and the rotary shaft unit 61 of the feed rotary gear 45 and the tape core 41 of the take-up reel 4 are respectively engaged with the rotary support shaft 11 of the case main body 5 and the rotary shaft unit 46*a* of the take-up rotary gear 46 from the upper side, and, at the same time, the coat film transfer head H is positioned and inserted in the inserting groove 10*a* of the case main body 5, so as to be set instantly.

In this case, if the feed rotary gear 45 and the take-up rotary gear 46 are not engaged with each other precisely, by rotating and manipulating the take-up reel projected and exposed outside from the outer periphery of the support board 20 by finger, the both gears 45, 46 can be easily meshed with each other.

At this time, the positioning and engaging portions 23*a*, 23*a*, 23*a* of the support board 20, and the head positioning and engaging portion 23*b* are simultaneously engaged with the positioning pins 9*a*, 9*a*, 9*a* of the case main body 5 and the head positioning portion 19, respectively. In the positioned mounted state of the support board 20, in collaboration with the rotary support shafts 11, 12, the support board 20 holds and supports the feed reel 3 and take-up reel 4 from both sides so as to be rotatable.

On the other hand, by pinching the handling knob 25 of the support base 20 by finger, and lifting directly to the upper side, the feed rotary gear 45, the tape core 41 and coat film transfer head H can be easily detached instantly from the rotary support shaft 11, rotary shaft portion 46*a* of the take-up rotary gear 46, and inserting groove 10*a*, respectively.

Thus, while the tape cartridge C is mounted on the case main body 5, by closing the cap body 6 by oscillating and stopping the case main body 5 in the procedure mentioned above, the coat film transfer tool 1 is completed. In this case, the rewind button 71 and the handling knob 25 are opposite to outside through the opening 14 of the cap body 6 and the slit 15, and the coat film transfer head H projects outside through the head insertion portion 10.

In this case, since the base end support portion 52 (54) of the coat film transfer head H is held on the head holding portion 53 of the support board 20 rotatably about the head axial center, and therefore in the state of the tape cartridge C being mounted on the case 2, the coat film transfer head H can rotate about the head axial center in the rotating angle range specified by the head insertion portion 10 of the case 2 which is the rotating angle defining portion, and the position of the coat film transfer head H can be held in optimum state depending on the application or manner of holding by the user.

In particular, as in the case of the illustrated embodiment, by setting the constitution of the rotating angle defining portion 10 so as to allow the rotation of the coat film transfer head H so that the leading end pressurizing portion 55 of the coat film transfer head H may rotate the coat film transfer tape T only in a range of a specified angle θ in both directions (in the illustrated embodiment, θ is nearly 43 degrees), from the angle position for guiding nearly opposite to the gripping surfaces 2*a*, 2*b* of the case 2, the user can hold the coat film transfer tool 1 in a same position as when holding a writing tool, and it can be used by drawing horizontally same as when using a writing tool, so that a favorable sense of using in horizontal drawing suited to the case of correcting part of letters written horizontally as in alphabet is assured.

Figure 12A:
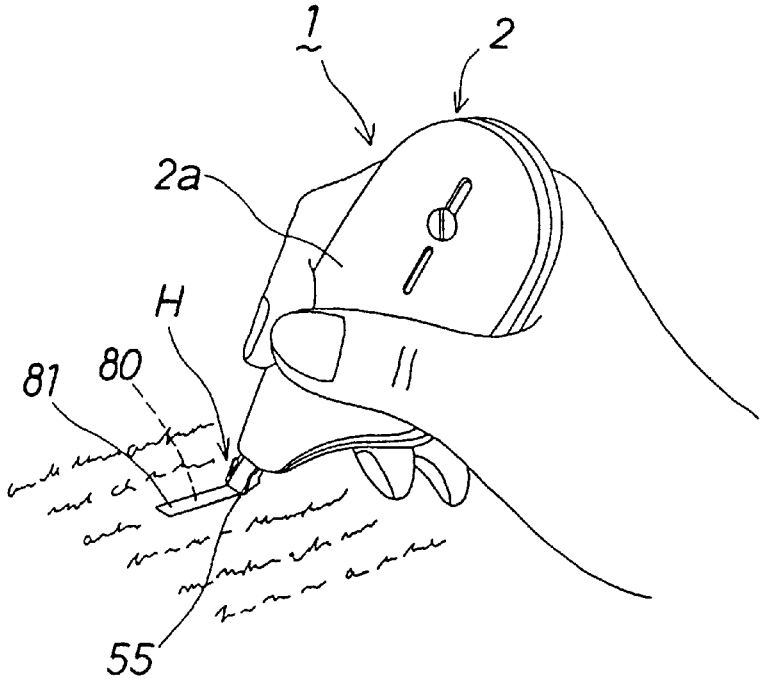
FIG. 12(*a*) is a perspective view showing the state of use of the eraser when correcting a part of alphabetic letters.
Figure 12B:
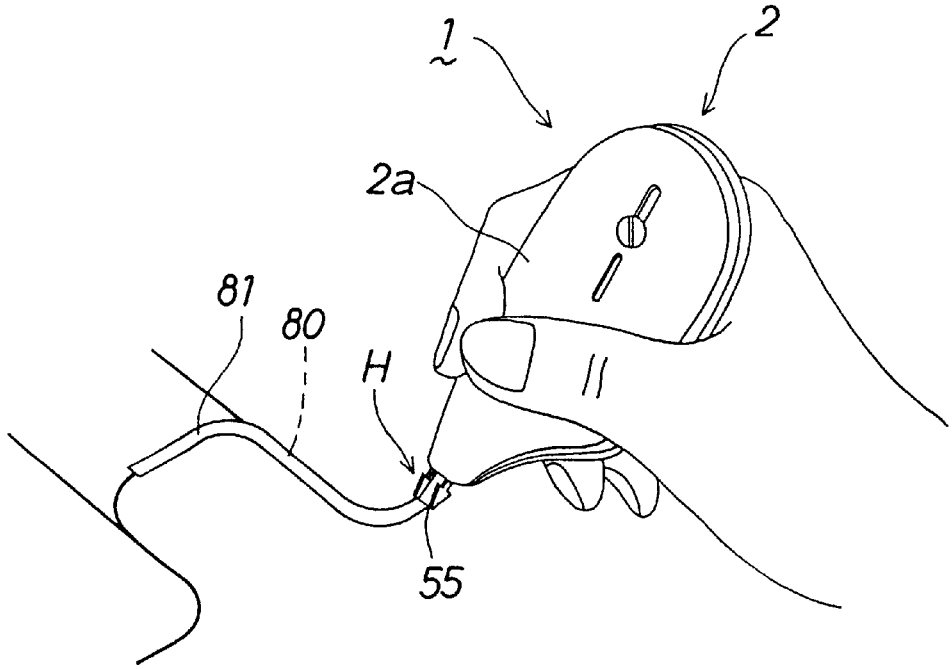

That is, in thus constituted coat film transfer tool 1, for example, when correcting part of alphabetic letters, as shown in FIG. 12(*a*), the gripping surface 2*a*, 2*b* of the case 2 are held by fingers in a position of holding a writing tool. In this holding position, the leading end pressurizing portion 55 of the coat film transfer head H is tightly pressed to the start end (left end) of correction area (transfer area) 80 on the sheet of paper for correcting a wrong letter or the like, and the case 2 is directly moved in the lateral direction, that is, to the right direction on the sheet of paper, and is stopped at the terminal end (right end) of the correction area 80.

By this manipulation, a corrective paint layer (white) 81 of the coat film transfer tape T in the pressurizing portion 55 of the coat film transfer head H is peeled from the film base material, and is transferred and applied on the correction area 80. As a result, the wrong letter is deleted, and it is possible to write a correct letter directly thereon.

On the other hand, not only a linear portion such as a string of characters as mentioned above, but also a curved portion such as graphic pattern can be corrected precisely according to the curve as shown, for example, in FIG. 12(*b*).

In the foregoing operation, since the illustrated coat film transfer tool 1 has a structure suited to a right-handed use as the basic constitution of the coat film transfer head H, it is designed to the right-handed user, but since the coat film transfer head H is desired to be rotated in a range of a specified angle θ, and therefore if a left-handed person uses, the coat film transfer head h can be held at an optimum position, according to the own manner of holding, same as in the case of the right-handed user.

Paying attention to the inside mechanism and operation of the coat film transfer tool 1, by such pressuring manipulation of the coat film transfer head H, when the tensile force (in the arrow A direction in FIG. 4) applied to the coat film transfer tape T acts as on the feed reel 3 as torque, the feed rotary gear 45 rotates through the tape core 40 of the feed reel 3 and further the clutch mechanism 50. This torque causes to rotate the take-up rotary gear 46, by the tape interlocking unit D, and further interlocks the take-up reel 4 integral in the rotating direction, thereby automatically taking up the coat film transfer tape T' after use.

In this case, the rotation ratio of the feed rotary gear 45 and take-up rotary gear 46 (corresponding to the gear ratio of the tape interlocking unit D) is always constant, but the ratio of the outside diameter of the coat film transfer tape T on the feed reel 3 and the outside diameter of the coat film transfer tape T' on the take-up reel 4 changes in the time course and is not always constant. That is, as used repeatedly, the outside diameter of the coat film transfer tape T on the feed reel 3 decreases while the outside diameter of the coat film transfer tape T' on the take-up reel 4 increases gradually to the contrary.

As a result, the take-up speed of the take-up reel 4 becomes faster gradually as compared with the feed speed the feed reel 3, and the synchronism of the both speeds is broken, and the torque acting on the feed reel 3 gradually increases. Consequently, this torque overcomes the frictional force of the clutch mechanism 50, and the tape core 40 slips on the feed rotary gear 45, and the torque difference of the reels 3, 4 is canceled, and the feed speed is synchronized with the take-up speed, so that smooth running of the coat film transfer tape T is assured.

As mentioned above, since the power transmission in the clutch mechanism 50 makes use of the frictional force by thrust load between the tape core 40 and the engaging protrusions 70, 70, . . . of the lead rotary gear 45, the constitution of the clutch mechanism 50 can set the frictional force at an optimum value by properly adjusting the relative dimensions in the thrust direction among the constituent members 3, 45, 71, mutually.

Incidentally, due to handling error by the user or the like, if the coat film transfer tape T slacks between the feed reel 3 and take-up reel 4, the rewind button 71 is rotated and manipulated from the outside of the case 2 to the rewinding direction (rotating in the direction of arrow B in FIG. 4), and the slack of the coat film transfer tape T is cleared and removed.

In this case, the torque in the rewinding direction B applied to the rewind button 71 is directly transmitted to the tape core 40 through the rotating and engaging portions 75, 75, . . . also serving as the axial engaging portions, so that the tape core 40 is rotated in the rewinding direction B. On the other hand, by the reverse rotation preventive force by the reverse rotation preventive mechanism 65 and the slipping action of the clutch mechanism 50, the rotary gears 45, 46 of the tape interlocking unit D and the tape core 41 of the take-up reel 4 are in stopped state. As a result, the slack of the coat film transfer tape T between the both reels 3, 4 is cleared and eliminated.

Moreover, by the use of the coat film transfer tool 1, when the coat film transfer tape T wound on the feed reel 3 is taken up and collected on the take-up reel 4 completely as the used tape T', the entire tape cartridge C is replaced with a new tape cartridge, and this replacement is done instantly.

That is, in the tape cartridge C, as mentioned above, the support board 20 is designed to support rotatably the opposite side end faces 21*a*, 22*a* of the rotary shafts 31, 32 of both the reels 3, 4 supported on the rotary support shafts 11, 12 of the case 2, and setting of the coat film transfer tape T on the coat film transfer head H is already completed in the stage of product.

Accordingly, the user holds the support board 20 to allow the rotary shaft 31 (specifically the rotary shaft portion 61 of the feed rotary gear 45) and the rotary shaft 32 (specifically the tape core 41) of the both reels 3, 4 to be engaged with the rotary support shaft 11 and rotary support shaft 12 of the case 2 (specifically the rotary shaft portion 46*a* of the take-up rotary gear 46), and puts the tape cartridge C into the case 2 while positioning and arranging the coat film transfer head H into the specified leading end position of the case 2, that is, the inserting groove 10*a* (this positioning operation is easy by the positioning means 23*a*, 23*b*, 9*a*), thereby completing the replacing work.

Embodiment 2

Figure 13A:
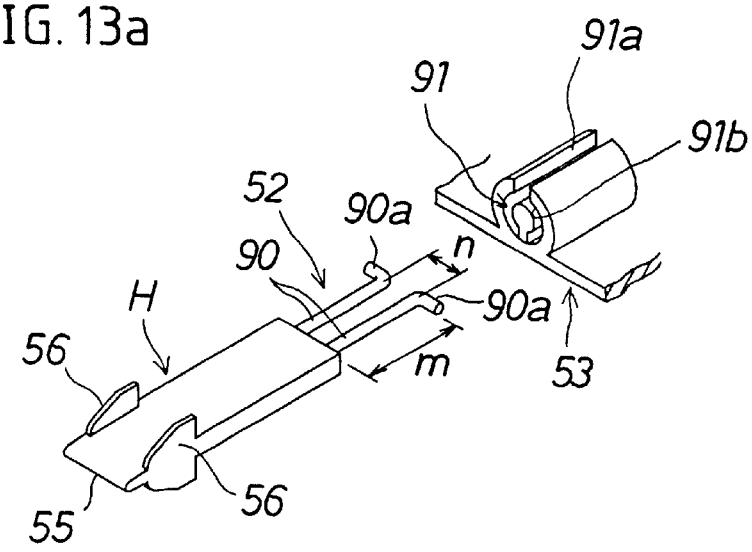
FIG. 13(*a*) is a perspective exploded view of a base end support portion of a coat film transfer head and a head holding portion of a support board, relating to a support structure of the coat film transfer head of a tape cartridge in an eraser in embodiment 2 of the invention.
Figure 13B:
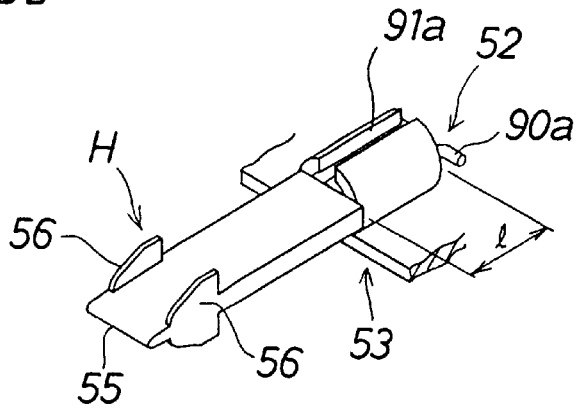
Figure 13C:
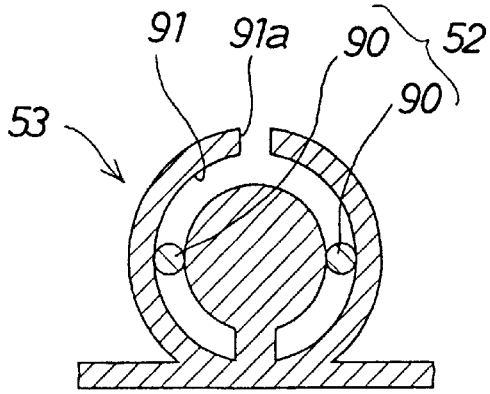

This embodiment is shown in FIG. 13, in which the specific constitution of the base end support unit 52 of the coat film transfer head H and the head holding portion 53 of the support board 20 is modified.

That is, the base end support unit 52 of the coat film transfer head H is, as shown in FIG. 13(*a*), composed of a pair of integrally formed fine linear bars 90, 90 extending parallel to the head axial direction from the base end of the coat film transfer head H.

The linear bar 90 is circular in section and in a columnar form with the diameter nearly equal to the thickness of the main body portion of the coat film transfer head H. The both linear bars 90, 90 are arranged parallel to the head axial line of the coat film transfer head H and at an equal distance from this axial line, and rear end portions 90*a*, 90*a* are folded and formed vertically to the outside in the lateral direction to compose anti-slipping portions.

On the other hand, the head holding portion 53 of the support board 20 is formed in a nearly cylindrical shape as shown in FIG. 13(*a*) and FIG. 13(*c*), and an annular fitting groove 91 is provided in the inside.

This fitting groove 91 has the width corresponding to the outside diameter of the linear bar 90 of the coat film transfer head H, and is opened outward at the vertex of the head holding portion 53. This opening 91*a* functions as a mounting opening for the linear bars 90, 90 of the coat film transfer head H.

The length l of the head holding portion 53 is set nearly same as the length m of the linear bar 90, and the inside diameter 91*b* of the fitting groove 91 is nearly same as the outside diameter n of the pair of linear bars 90, 90.

In the state of the both linear bars 90, 90 being installed in the fitting groove 91 of the head holding portion 53 as shown in FIG. 13(*b*) and FIG. 13(*c*), the both linear bars 90, 90 are oscillatable along the fitting groove 91, more specifically along the cylindrical inner side 91*b*, and the base end face of the coat film transfer head H and the anti-slipping portions 90*a*, 90*a* of the linear bars 90, 90 are engaged with the head holding portion 53 from the front and rear sides. As a result, the coat film transfer head H is rotatably supported in the head holding portion 53 of the support board 20, and is positioned in the head axial direction.

The other constitution and action are same as in embodiment 1.

Embodiment 3

This embodiment is shown in FIG. 14, in which, same as in embodiment 2, the specific constitution of the base end support unit 52 of the coat film transfer head H and the head holding portion 53 of the support board 20 is modified.

That is, the base end support unit 52 of the coat film transfer head H is, as shown in FIG. 14(*a*), composed of an integrally formed plate member 95 extending in the head axial direction from the base end of the coat film transfer head H.

The width of the plate member 95 is smaller than the width of the main body portion of the coat film transfer head H, and its central axial line is coaxial with the head axial line, and its thickness is set slightly smaller than the thickness of the main body portion of the coat film transfer head H. Both side edges 95*a*, 95*a* of the plate member 95 are formed of a part of the cylindrical surface of which width is the diameter, and its rear end portion 95*b* projects outward in the lateral direction to compose an anti-slipping portion.

On the other hand, the head holding portion 53 of the support board 20 is formed in a nearly cylindrical shape as shown in FIG. 14(*a*) and FIG. 14(*c*), and is opened outward at its vertex. This opening 96 functions as a mounting opening for the plate member 95 of the coat film transfer head H.

The length l of the head holding portion 53 is set nearly same as the length m of the plate member 95, and the inside diameter 97 of the head holding portion 53 is nearly same as the outside diameter n of the both side edges 95*a*, 95*a* of the plate member 95.

In the state of the plate member 95 being installed in the cylindrical inner side 97 of the head holding portion 53 as shown in FIG. 14(*b*) and FIG. 14(*c*), the both side edges 95*a*, 95*a* of the plate member 95 are oscillatable along the cylindrical inner side 97, and the base end face of the coat film transfer head H and the anti-slipping portion 95*b* of the plate member 95 are engaged with the head holding portion 53 from the front and rear sides. As a result, the coat film transfer head H is rotatably supported in the head holding portion 53 of the support board 20, and is positioned in the head axial direction.

The other constitution and action are same as in embodiment 1.

Embodiment 4

Figure 15A:
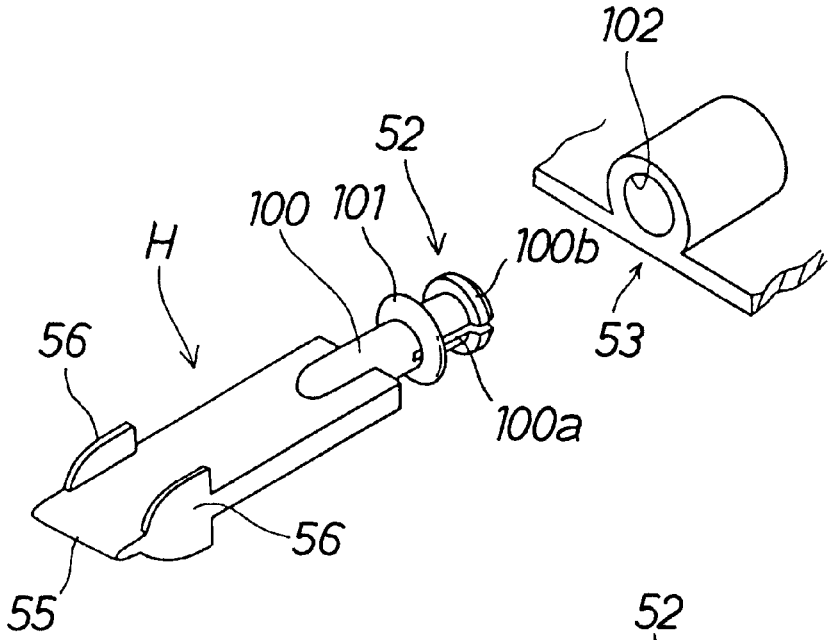
FIG. 15(*a*) is a perspective exploded view of a base end support portion of a coat film transfer head and a head holding portion of a support board, relating to a support structure of the coat film transfer head of a tape cartridge in an eraser in embodiment 4 of the invention.
Figure 15B:
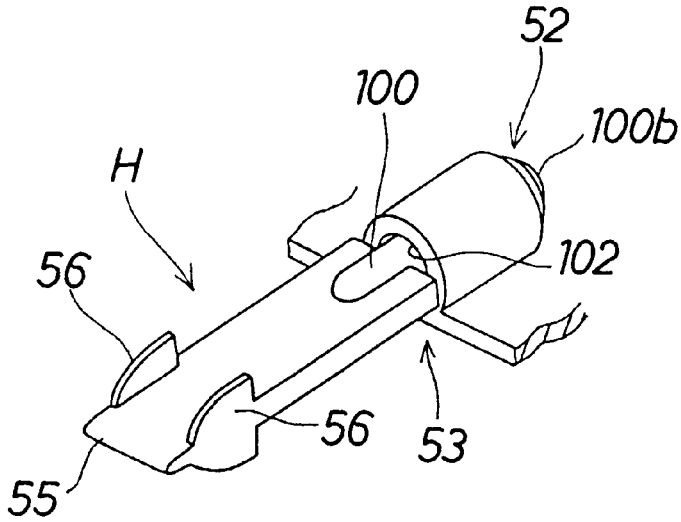
Figure 15C:
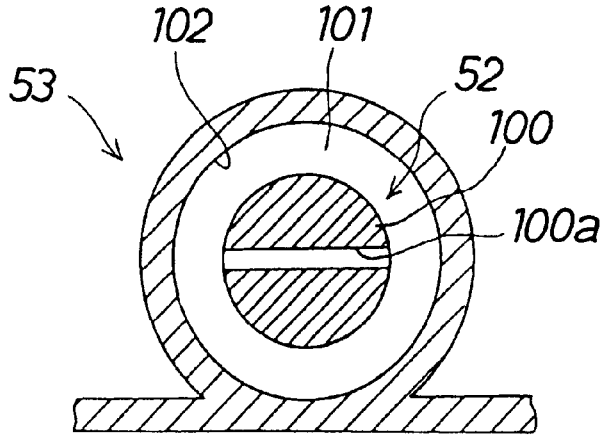

This embodiment is shown in FIG. 15, being slightly modified from embodiment 1, in which the adjusting rotating angle position of the coat film transfer head H is designed to be held for a certain extent.

That is, the base end support unit 52 of the coat film transfer head H is, as shown in FIG. 15(*a*), composed of an integrally formed bar shaft 100 extending in the head axial direction from the base end of the coat film transfer head H, and an annular frictional member 101 is mounted on the outer circumference of this shaft 100.

More specifically, on the outer circumference of the shaft 100 formed in a columnar bar in the same structure as the columnar bar 54 of the base end support unit 52 of the coat film transfer head H in embodiment 1, an elastic rubber annular frictional member 101 made of O-ring or the like is provided. Reference numeral 100*a* is a slit, and 100*b* is an anti-slipping portion.

On the other hand, the head holding portion 53 of the support board 20 is formed in a cylindrical shape as shown in FIG. 15(*a*) and FIG. 15(*c*), and its cylindrical inner side 102 has a diameter corresponding to the outside diameter of the annular frictional member 101, so that the annular frictional member 101 may be rotatably held in a frictional engagement state.

In the state of the shaft 100 of the coat film transfer head H being installed in the cylindrical inner side 102 of the head holding portion 53 through the annular frictional member 101 as shown in FIG. 15(*b*) and FIG. 15(*c*), the annular frictional member 101 being integral with the shaft 100 is oscillatable in the rotating direction in the frictional engagement state with the cylindrical inner side 102, and the base end face of the coat film transfer head H and the anti-slipping portion 100*b* of the shaft 100 are engaged with the head holding portion 53 from the front and rear sides. As a result, the coat film transfer head H is rotatably supported in the head holding portion 53 of the support board 20, and is positioned in the head axial direction.

Moreover, by frictional engagement of the annular frictional member 101 and cylindrical inner side 102, the coat film transfer head H is positioned and held at a specified rotating angle position with a certain holding force, and by the elastic force of the annular frictional member 101, it is tiltable elastically in lateral and vertical direction in a slight range allowed by the head insertion unit 10 of the case 2. Instead, as the annular frictional member 101, by using an annular member made of non-elastic frictional member, a support structure not allowing tilting of the coat film transfer head H may be also constituted.

The other constitution and action are same as in embodiment 1.

Embodiment 5

Figure 16A:
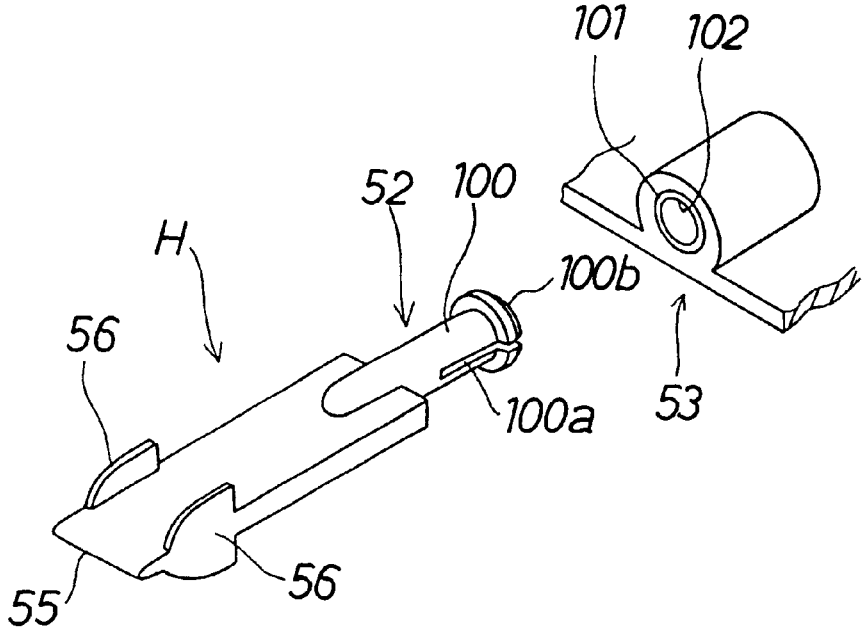
FIG. 16(*a*) is a perspective exploded view of a base end support portion of a coat film transfer head and a head holding portion of a support board, relating to a support structure of the coat film transfer head of a tape cartridge in an eraser in embodiment 5 of the invention.
Figure 16B:
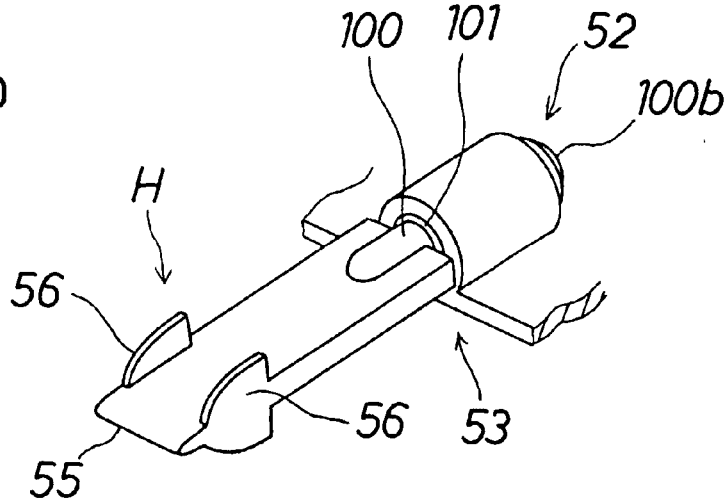
Figure 16C:
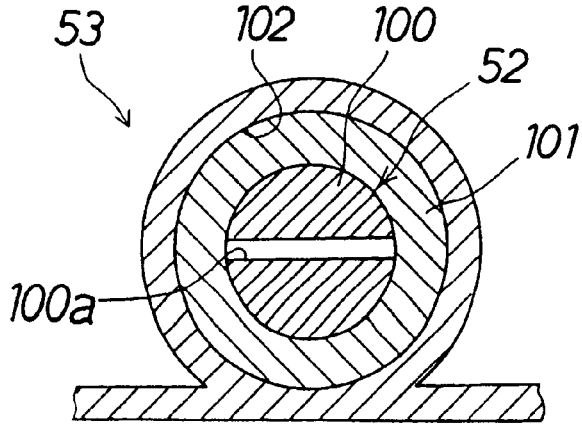

This embodiment is shown in FIG. 16, being slightly modified from embodiment 4, in which, as the cylinder frictional member 101, the rubber-made annular frictional member in embodiment 4 is replaced by a rubber-made cylindrical frictional member along the cylindrical inner side 102.

This cylindrical frictional member 101 is specifically made of a frictional material such as rubber having the same elasticity as in embodiment 4, and it is fixed on the cylindrical inner side 102 of the head holding unit 53, and the shaft 100 of the coat film transfer head H is rotatably supported in a frictional engagement state.

The other constitution and action are same as in embodiment 4.

Embodiment 6

Figure 17A:
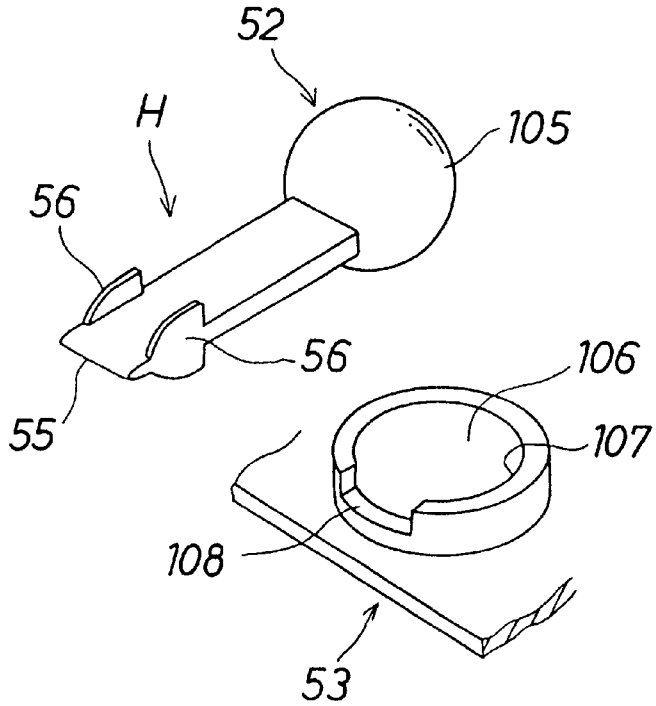
FIG. 17(*a*) is a perspective exploded view of a base end support portion of a coat film transfer head and a head holding portion of a support board, relating to a support structure of the coat film transfer head of a tape cartridge in an eraser in embodiment 6 of the invention.
Figure 17B:
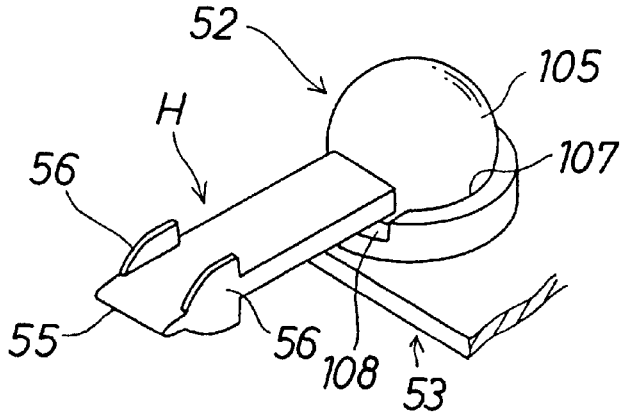
Figure 17C:
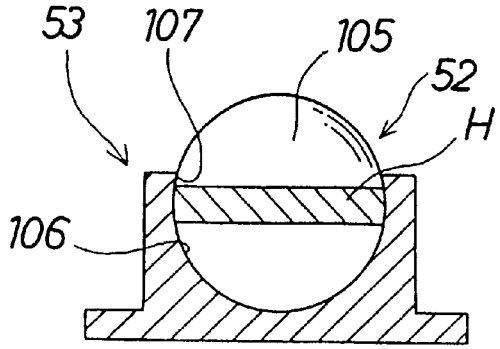

This embodiment is shown in FIG. 17, in which the specific constitution of the base end support unit 52 of the coat film transfer head H and the head holding portion 53 of the support board 20 is modified.

That is, the base end support unit 52 of the coat film transfer head N is, as shown in FIG. 17(*a*), composed of a spherical member integrally formed at the base end of the coat film transfer head H.

The spherical member 105 has its center positioned on the head axial center of the coat film transfer head H, and has the diameter larger than the width of the coat film transfer head H.

On the other hand, the head holding portion 53 of the support board 20 has a spherical inner side 106 as shown in FIG. 17(*a*) and FIG. 17(*c*), and its diameter is set according to the diameter of the spherical inner side 106, and the spherical member 105 of the coat film transfer head H is oscillatable and rotatably supported on this spherical inner side 106.

For this purpose, the upper opening 107 of the head holding portion 53 is formed in a cylindrical shape slightly smaller than the diameter of the spherical inner side 106, and at the front side portion of the head holding portion 53, a recess 108 is formed for allowing rotation and vertical and lateral tilting of the coat film transfer head H.

In the state of the spherical member 105 being installed in the spherical inner side 106 of the head holding portion 53 as shown in FIG. 17(*b*) and FIG. 17(*c*), the spherical member 105 is oscillatable and rotatable along the spherical inner side 106, and the coat film transfer head H is rotatable and tiltable in vertical and lateral directions in a slight range allowed by the head insertion portion 10 of the case 2.

The other constitution and action are same as in embodiment 1.

Embodiment 7

Figure 18A:
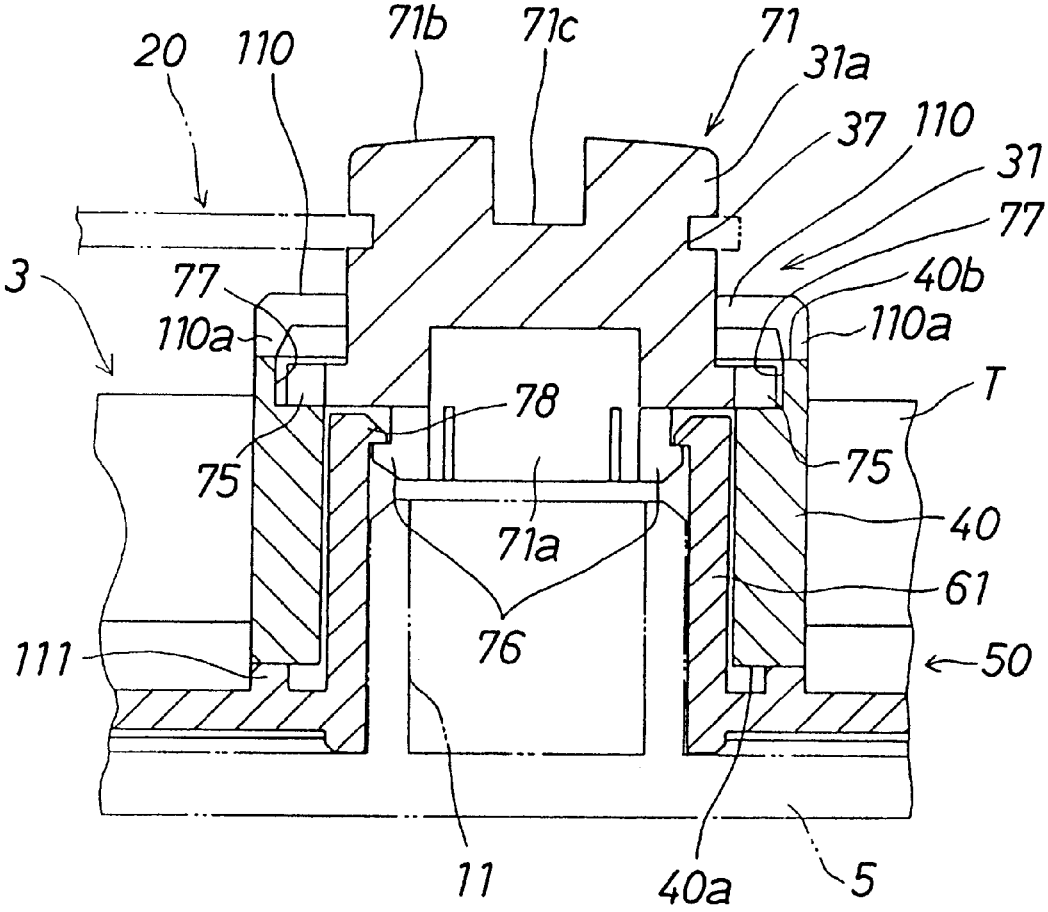
FIG. 18(*a*) is a front sectional view of the feed reel side position, showing principal parts of a tape cartridge in an eraser in embodiment 7 of the invention.
Figure 18B:
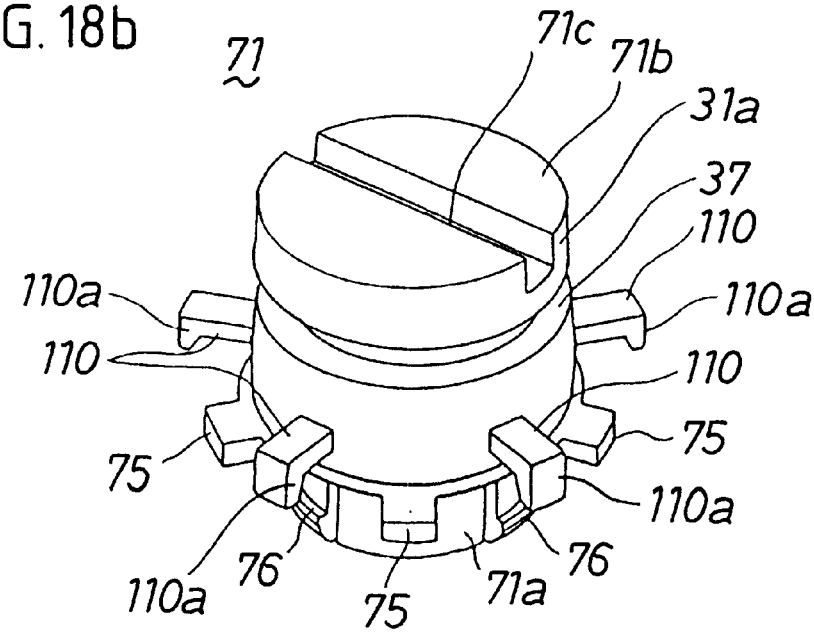

This embodiment is shown in FIG. 18, in which the specific constitution of the clutch mechanism 50 is modified.

That is, in the clutch mechanism 50 of the embodiment, engaging protrusions 110, 110, . . . are provided in a rewind button 71.

More specifically, engaging protrusions 110 are integrally formed at plural positions (five positions in the illustrated example) in the circumferential direction of the rewind button 71, extending horizontally in the radial direction. The engaging protrusions 110 are elastically deformable in the axial direction from the base end of the inner side, and are provided with engaging portions 110*a* bulging downward at the leading end of the outer circumferential side. In the illustrated embodiment, in consideration of ease of forming of the rewind button 71 by injection molding or the like, the engaging protrusions 110 are composed at equal intervals between the axial engaging portions 75, 75.

The engaging portions 110*a* of the engaging protrusions 110 are disposed at confronting positions of the axial end face 40*b* of the tape core 40, and are provided with flat faces of the axial end face 40, more specifically engaging flat surfaces corresponding to the outer side portions of the engaging recesses 77, 77,. . . .

In correspondence to the constitution of the engaging protrusions 110, 110 . . . , on the upper surface of the feed rotary gear 45, engaging ribs 111 are provided corresponding to the flat outer side portions of the axial end face 40*a* of the tape core 40, so that the axial end face 40*a* is supported in an frictional engagement state.

As the detent claws 76, 76 of the rewind button 71 are engaged with the engaging flanges 78 of the rotary shaft 61 to be arrested, the tape core 40 is held and supported from both sides in the axial direction by the engaging ribs 111 of the feed rotary gear 45 and the engaging protrusions 110, 110, . . . of the rewind button 71.

The engaging protrusions 110, 110, . . . are elastically and frictionally engaged with the axial end face 40*b* of the tape core 40 in the rotating direction with a specific pressing force, and the power transmission of the clutch mechanism 6, same as in the case of embodiment 1, makes use of the frictional engaging force by the thrust load acting between the axial end face 40*b* of the tape core 40 and the engaging protrusions 110, 110, . . . of the rewind button 71.

In this case, same as in embodiment 1, the frictional engaging force is set by properly adjusting the engaging dimensional relation between the feed rotary gear 45 and rewind button 71 in the axial direction, but in the embodiment, however, the axial engaging portion 75 of the rewind button 71 functions only as the rotation engaging portion of the tape rewind mechanism, but does not function as the axial engaging portion. Instead, in the embodiment, the engaging protrusions 110, 110, . . . function as the axial engaging portion. Hence, in the engaged state of the detent claws 76, 76 and the engaging flange 78, the dimensional relation is designed so that the engaging portions 75, 75, . . . may be engaged with the engaging recesses 77, 77, . . . of the axial end face 40*b* of the tape core 40 only in the rotating direction, and not engaged in the axial direction.

The other constitution and action are same as in embodiment 1.

Embodiment 8

Figure 19:
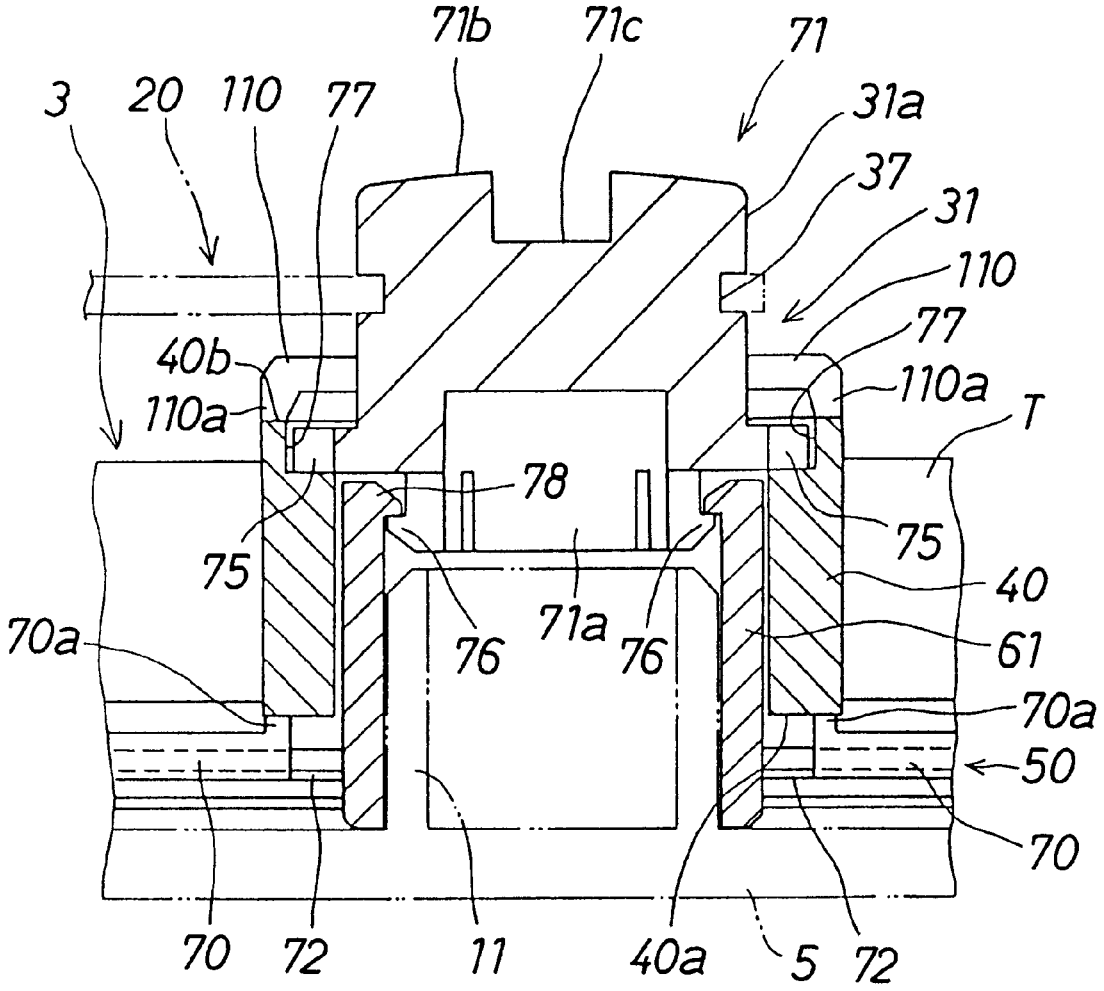
FIG. 19 is a front sectional view of the feed reel side position, showing principal parts of a tape cartridge in an eraser in embodiment 8 of the invention.

This embodiment is shown in FIG. 19, in which the specific constitution of the clutch mechanism 50 is modified.

That is, the clutch mechanism 50 of the embodiment is a combination of the constitution of embodiment 1 (FIG. 1 to FIG. 12) and constitution of embodiment 7 (FIG. 18).

More specifically, engaging protrusions 70, 70, . . . are integrally formed in the feed rotary gear 45, and engaging protrusions 110, 110, . . . are integrally formed in the rewind button 71, and the specific constitution of the engaging protrusions 70, 110 is same as in embodiment 1 and embodiment 7, respectively.

As the detent claws 76, 76 of the rewind button 71 are engaged with the engaging flanges 78 of the rotary shaft 61 to be arrested, the tape-core 40 is held and supported from both sides in the axial direction by the engaging protrusions 70, 70, . . . of the feed rotary gear 45 and the * engaging protrusions 110, 110, . . . of the rewind button 71.

The engaging protrusions 70, 110, . . . are elastically and frictionally engaged with the axial end faces 40*a*, 40*b* of the tape core 40 in the rotating direction with a specific pressing force, and the power transmission of the clutch mechanism 50 makes use of the frictional engaging force acting between the axial end faces 40*a*, 40*b* of the tape core 40 and the engaging protrusions 70, 110, . . . .

The other constitution and action are same as in embodiment 1.

Embodiment 9

Figure 20:
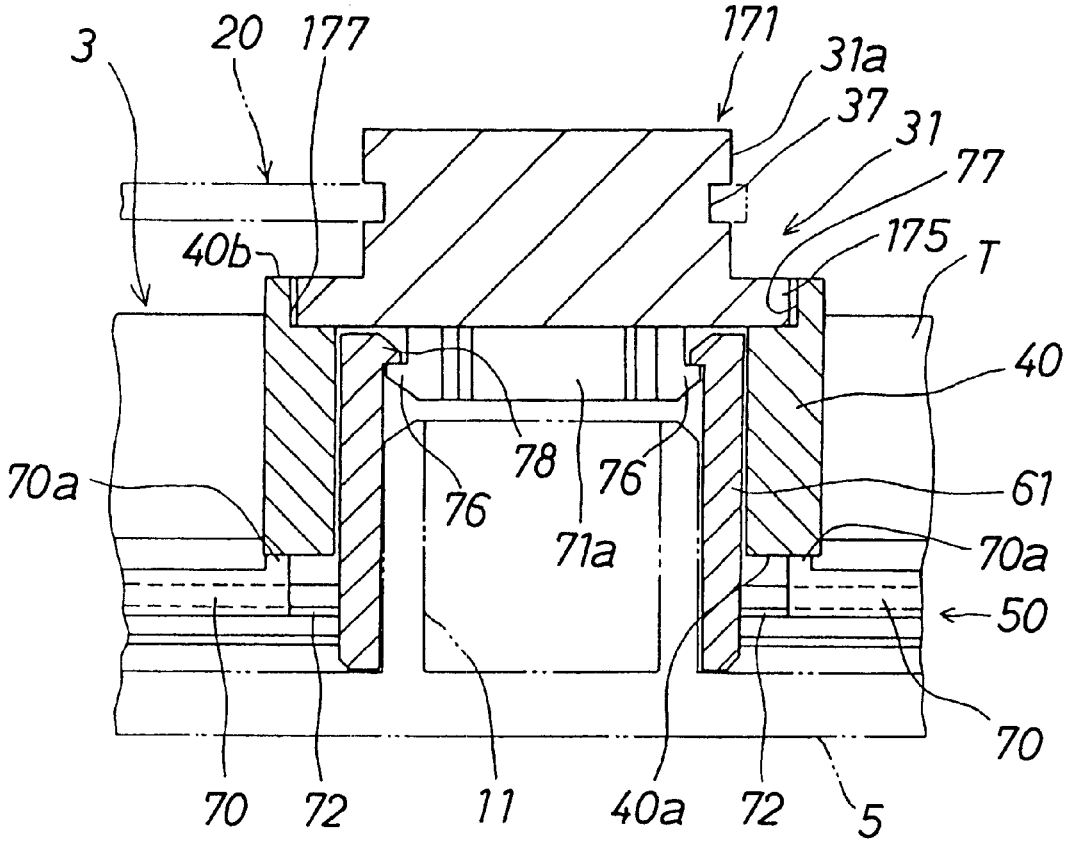
FIG. 20 is a front sectional view of the feed reel side position, showing principal parts of a tape cartridge in an eraser in embodiment 9 of the invention.
Figure 21:
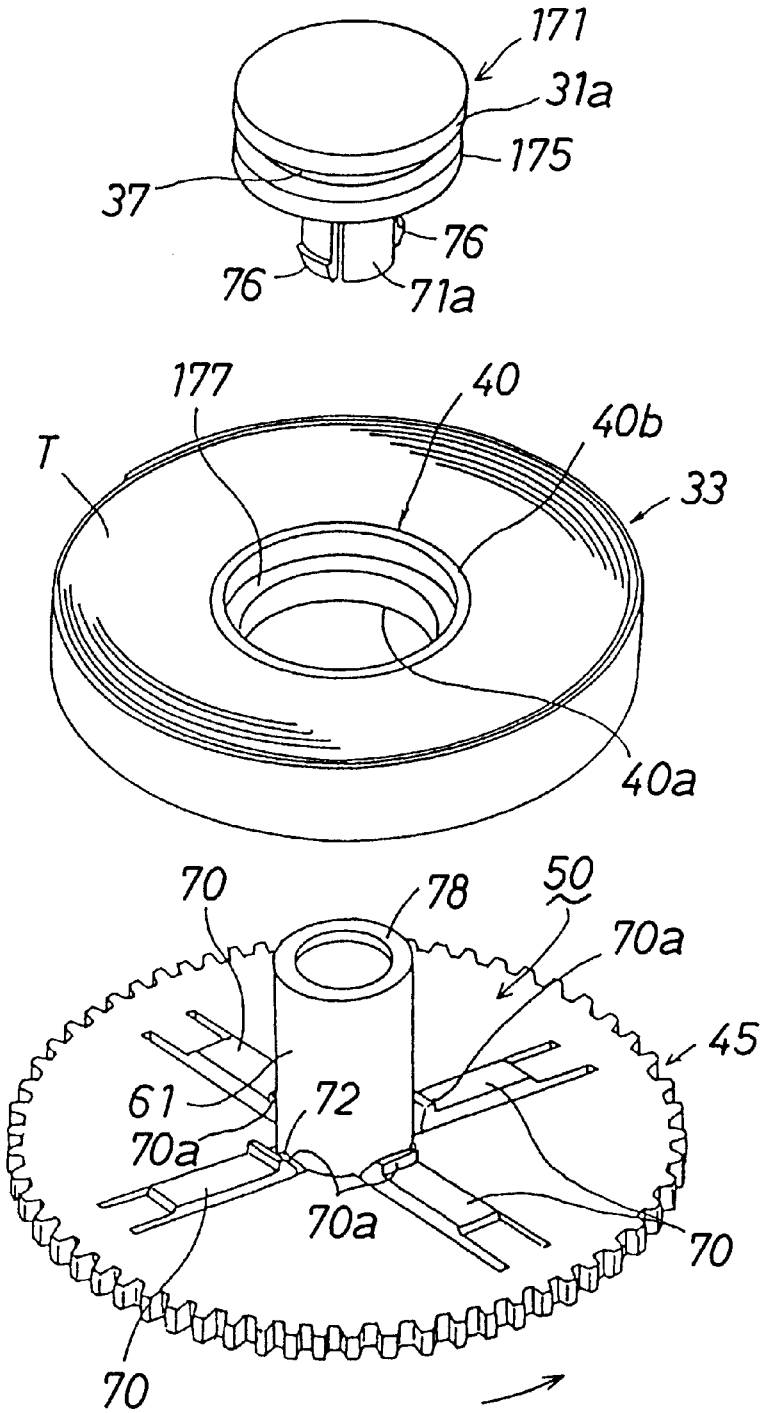
FIG. 21 is a perspective exploded view of the feed reel side position.

This embodiment is shown in FIG. 20 and FIG. 21, in which the specific constitution of the clutch mechanism 50 is modified.

That is, in the constitution of embodiment 1 (FIG. 1 to FIG. 12), the tape rewind mechanism is omitted.

More specifically, in the clutch mechanism 50, the engaging support member 171 is formed in a shape and size to be incorporated inside of the case 7, and the axial engaging portion 175 to be put in this engaging support member 171 is formed as an engaging flange, as shown in the drawing, projecting horizontally in the radial direction from the outer circumference of the engaging support member 171.

In correspondence, an engaging recess 177 is provided in the axial end face 40*b* of the tape core 40, and this engaging recess 177 is formed in an annular recess to be fitted with the outer circumference of the engaging flange 175.

The other constitution and action are same as in embodiment 1.

Embodiment 10

Figure 22A:
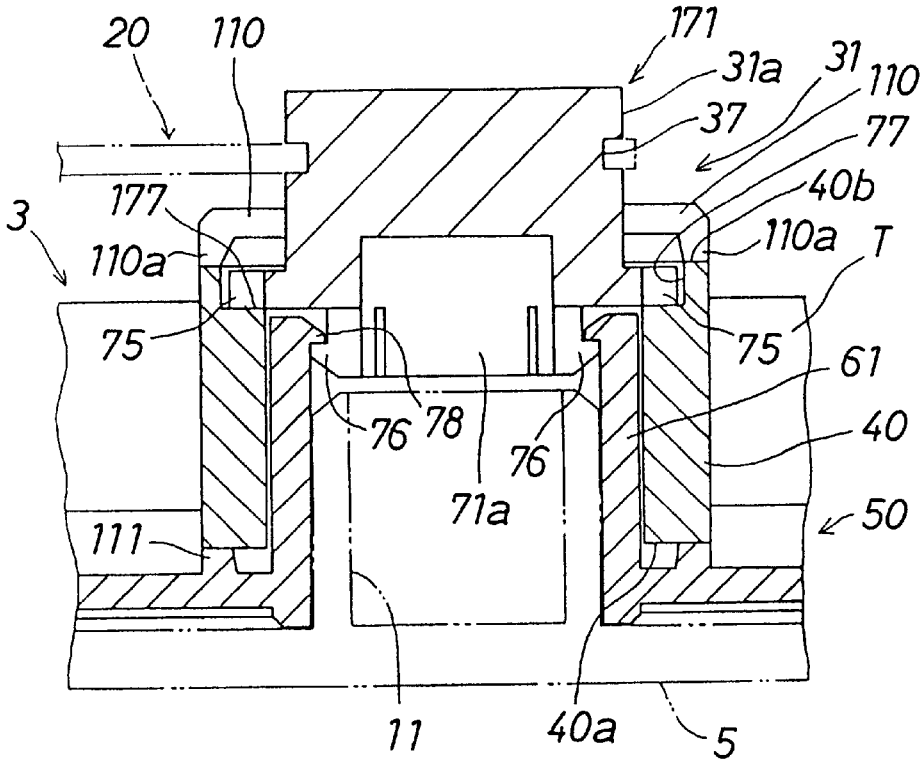
FIG. 22(*a*) is a front sectional view of the feed reel side position, showing principal parts of a tape cartridge in an eraser in embodiment 10 of the invention.
Figure 22B:
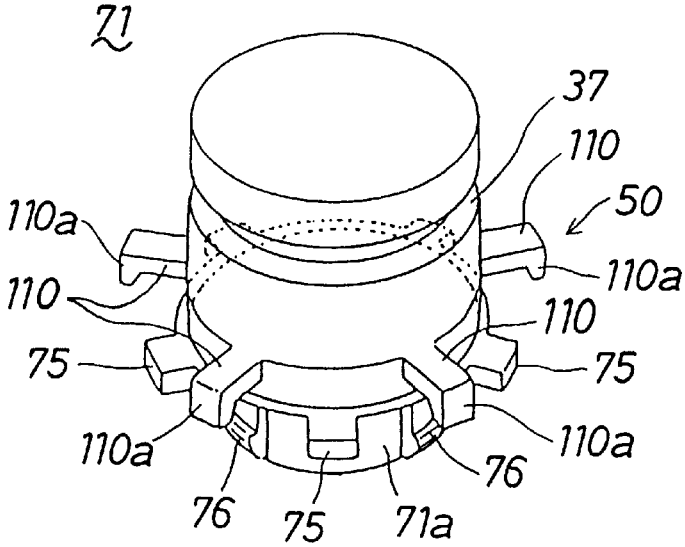

This embodiment is shown in FIG. 22, in which the specific constitution of the clutch mechanism 50 is modified.

That is, in the clutch mechanism 50 in which the tape rewind mechanism is omitted same as in embodiment 9, a frictional engaging member is integrally provided in the engaging support member 171.

More specifically, the clutch mechanism 50 of the embodiment is a combination of the constitution of embodiment 9 and the constitution of embodiment 7 (FIG. 8). In this case, same as in embodiment 7, in consideration of ease of forming of the engaging support member 171 by injection molding or the like, the engaging protrusions 110 are composed at equal intervals between the axial engaging portions 75, 75.

The other constitution and action are same as in embodiment 9.

Embodiment 11

Figure 23:
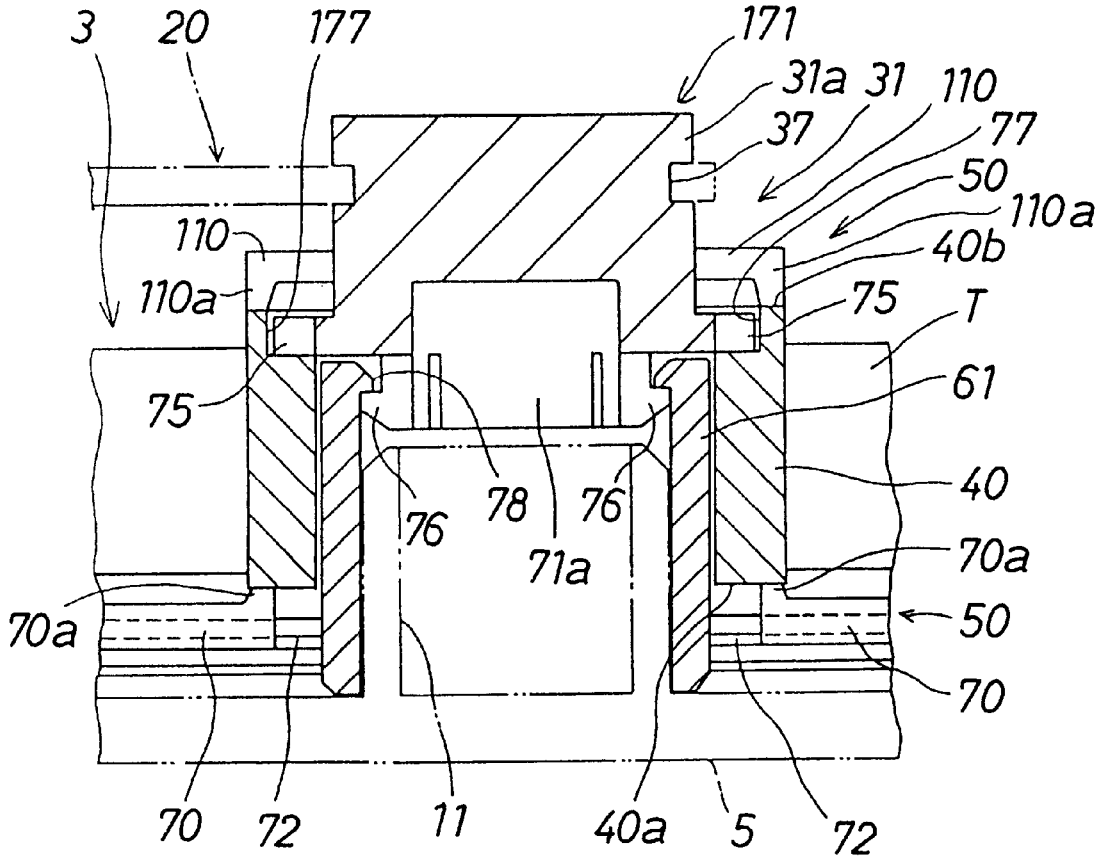
FIG. 23 is a front sectional view of the feed reel side position, showing principal parts of a tape cartridge in an eraser in embodiment 11 of the invention.

This embodiment is shown in FIG. 23, in which the specific constitution of the clutch mechanism 50 is modified.

That is, the clutch mechanism 50 of the embodiment is a combination of the constitution of embodiment 1 (FIG. 1 to FIG. 12) and the constitution of embodiment 10 (FIG. 22).

More specifically, engaging protrusions 70, 70, . . . are integrally formed in the feed rotary gear 45, and engaging protrusions 110, 110, . . . are integrally formed in the engaging support member 171, and the specific constitution of the engaging protrusions 70, 110 is same as in embodiment 1 and embodiment 10, respectively.

The other constitution and action are same as in embodiment 9.

Embodiment 12

Figure 24A:
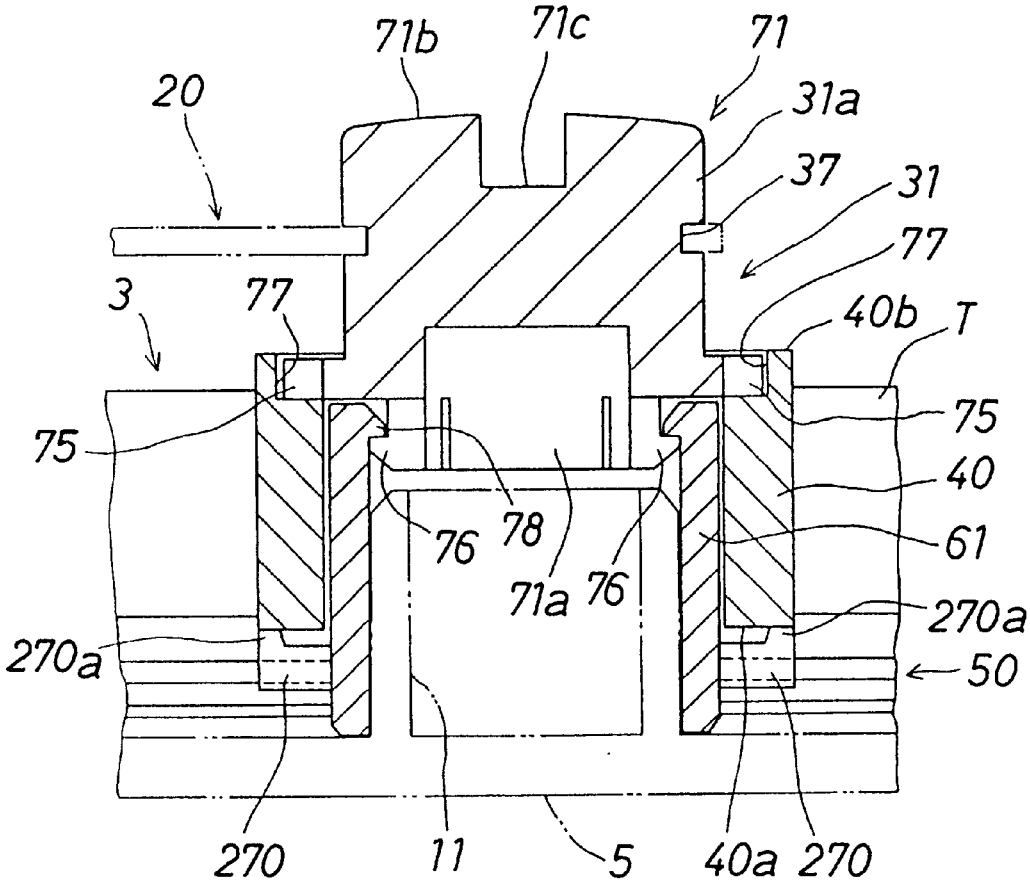
FIG. 24(*a*) is a front sectional view of the feed reel side position, showing principal parts of a tape cartridge in an eraser in embodiment 12 of the invention.
Figure 24B:
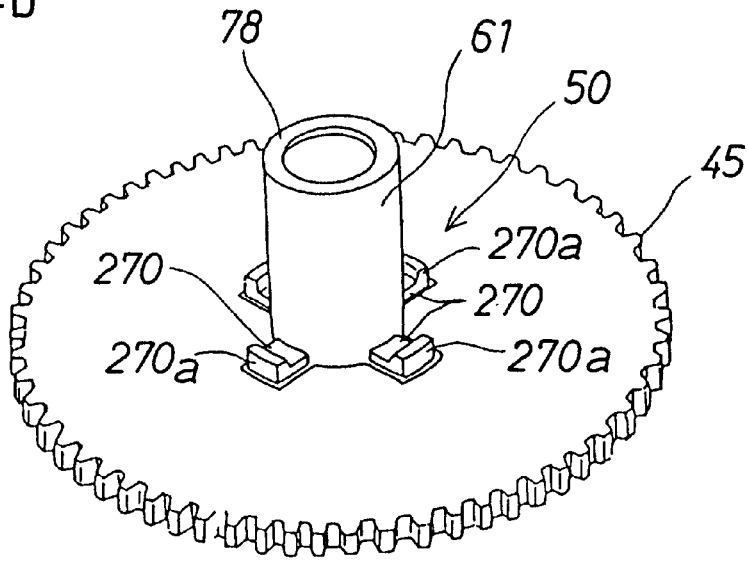
Figure 25A:
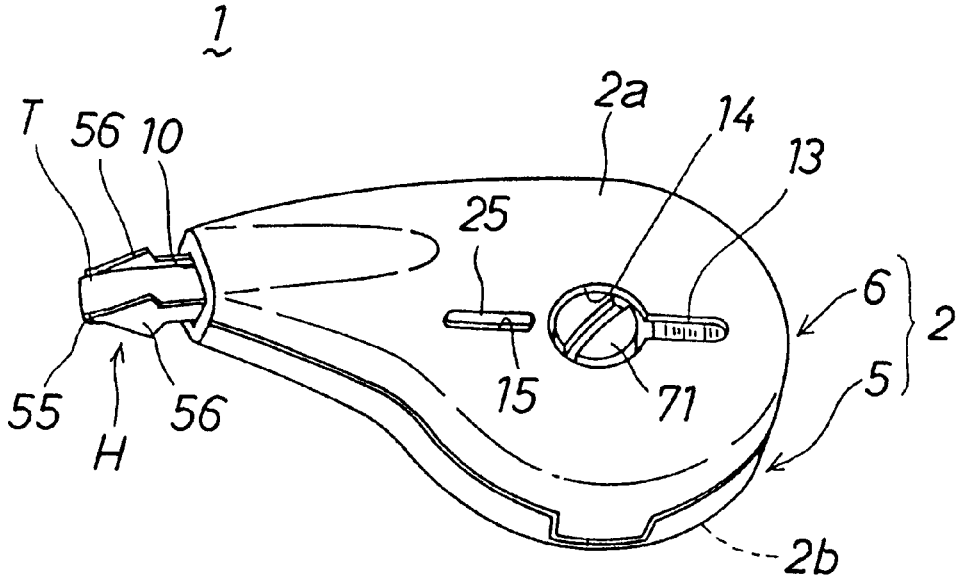
FIG. 25(*a*) is a perspective view showing an eraser in embodiment 13 of the invention.
Figure 25B:
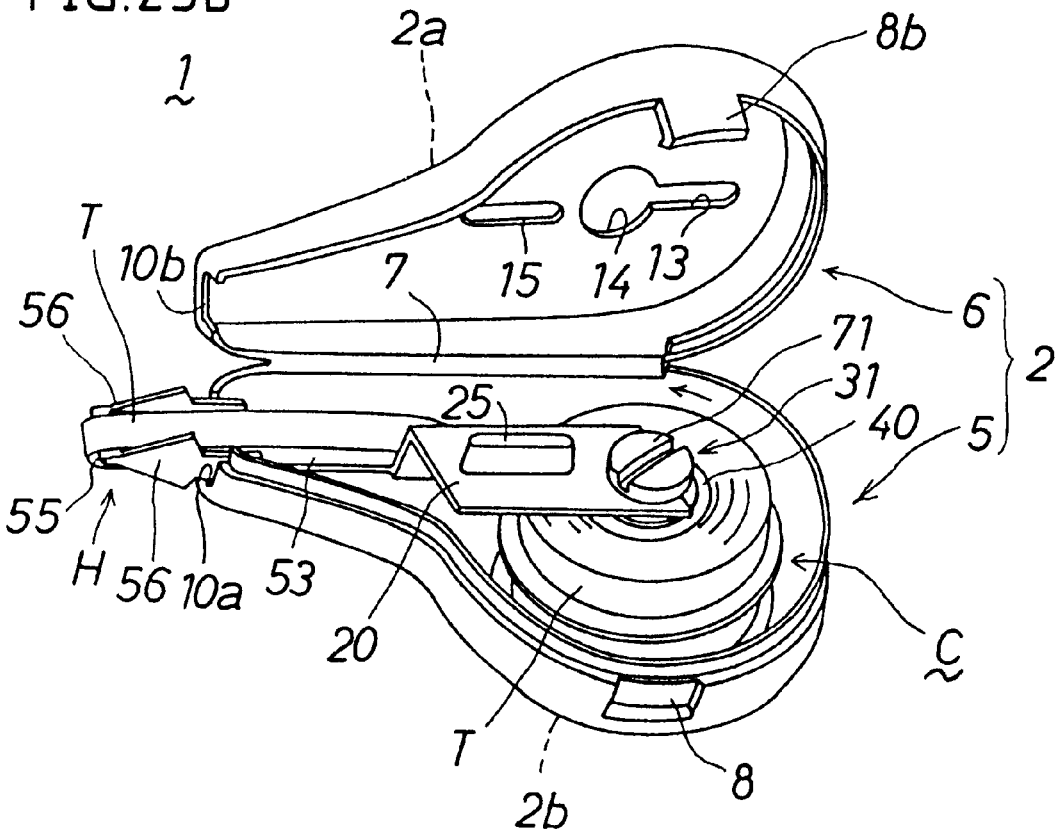
Figure 26:
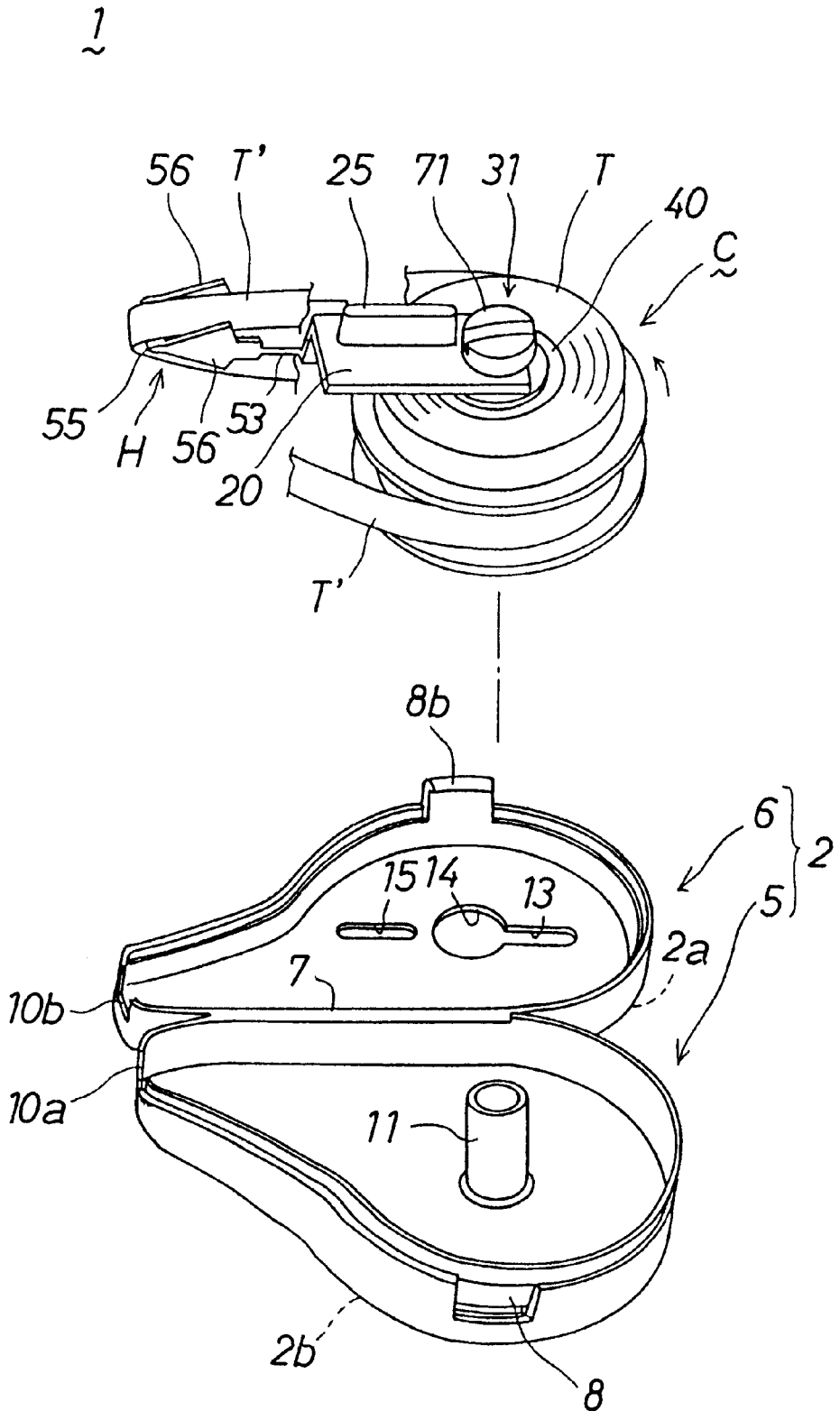
FIG. 26 is a perspective view showing the eraser by taking out the tape cartridge from the case main body.

This embodiment is shown in FIG. 24, in which the specific constitution of the clutch mechanism 50 is slightly modified.

Specifically, engaging protrusions (frictional engaging members) 270, 270, . . . integrally formed on the feed rotary gear 45 are extended from the rotary shaft 61 of the feed rotary gear 45 to the outer side in the radial direction, and the engaging portions 270*a*, 270*a*, . . . are frictionally engaged with the axial end face 40*a* of the tape core 40.

The other constitution and action are same as in embodiment 1.

Embodiment 13

This embodiment is shown in FIG. 25 through FIG. 28, in which, by contrast to embodiments 1 to 10 having the feed reel 3 and take-up reel 4 independently and rotatably supported on the support board 20 in the two-axis type reel structure, this is characterized by the one-axis type reel structure, that is, the feed reel 3 and take-up reel 4 are rotatably supported on the support board 20 coaxially and in a state being capable of rotating relatively.

Figure 27:
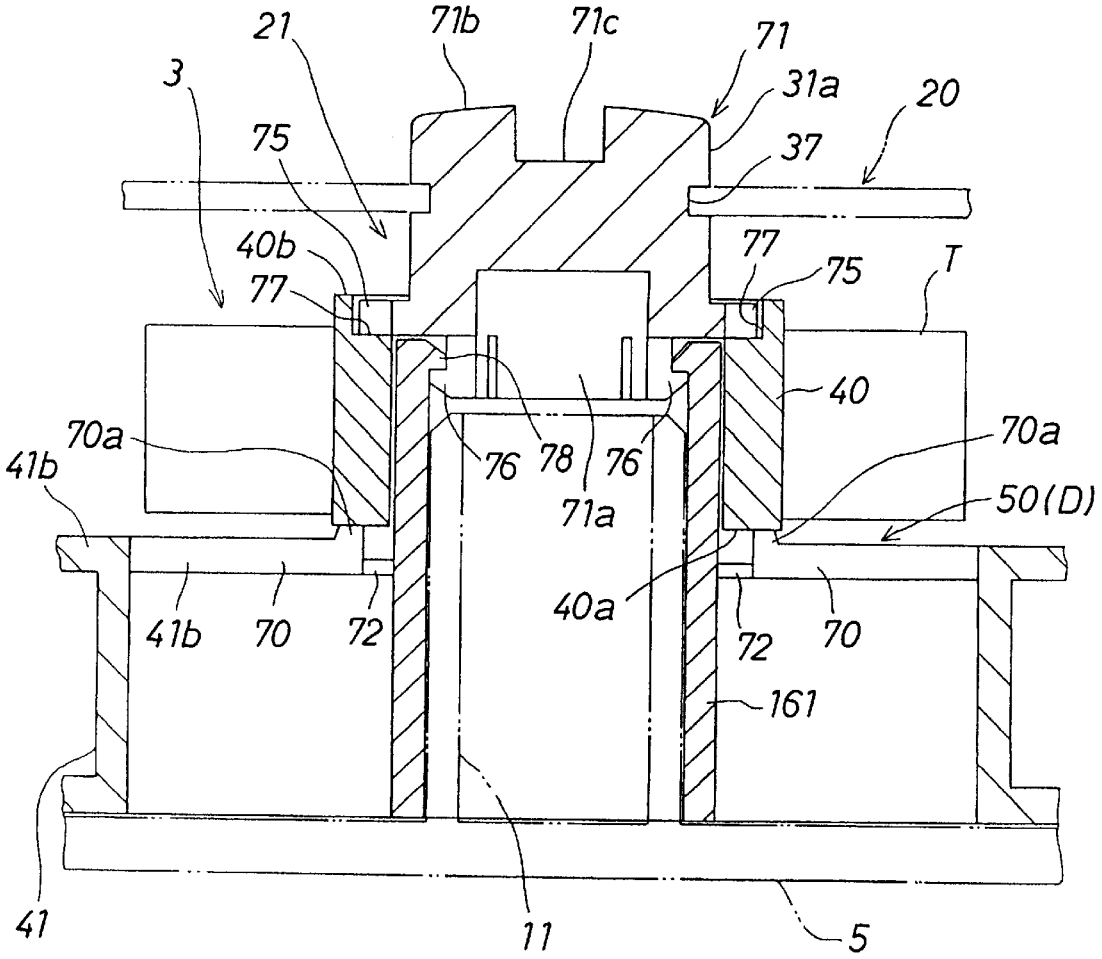
FIG. 27 is a front sectional view showing the position of the feed reel and take-up reel of the tape cartridge in the eraser.
Figure 28:
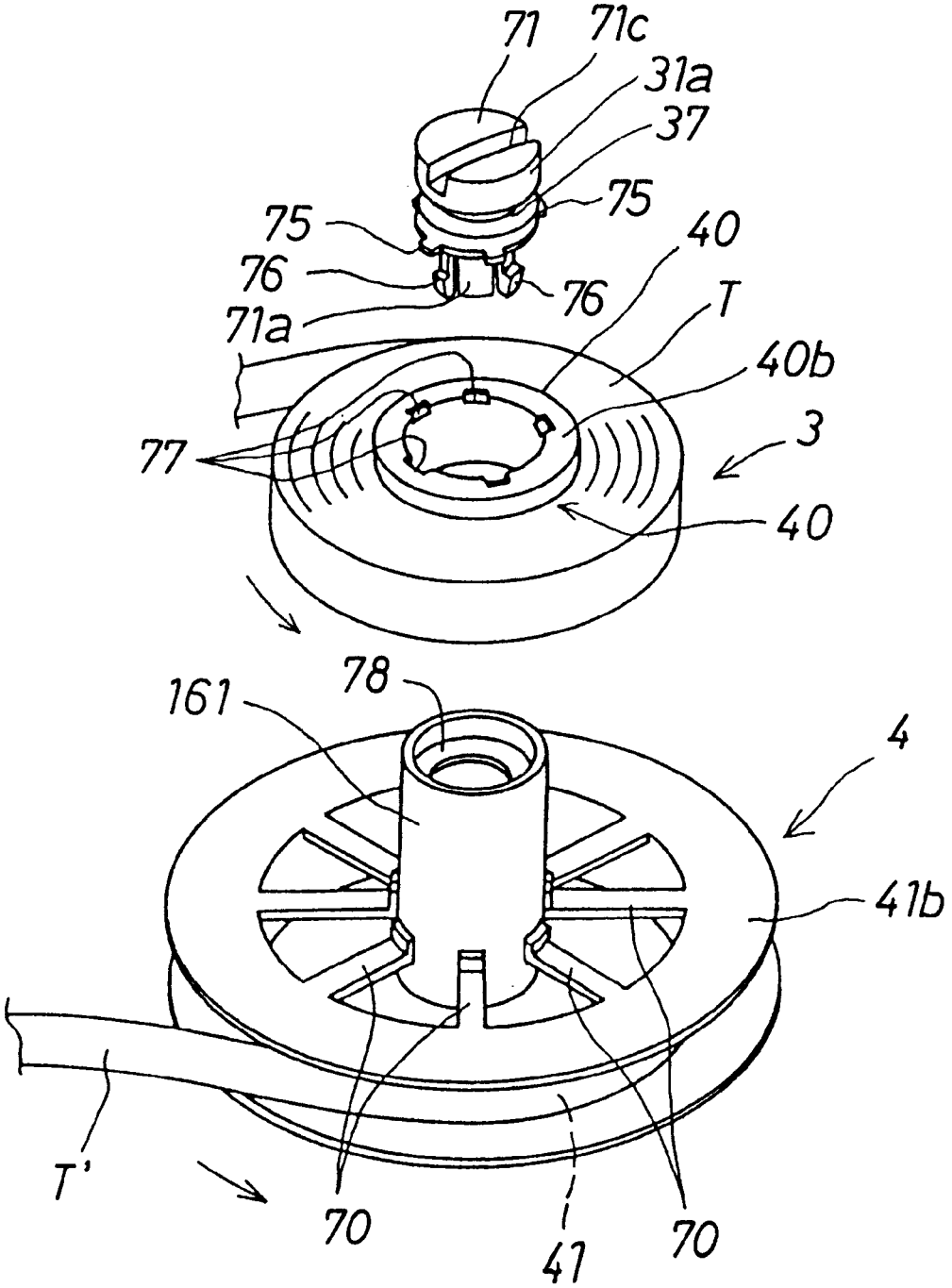
FIG. 28 is a perspective exploded view of the feed reel side position as a principle part of the tape cartridge of the eraser.

In this embodiment, as shown in FIG. 27 and FIG. 28, a rotary shaft (rotary drive unit) 161 is provided inside the tape core 41 of the take-up reel 4, being projected and extended to the upper side in the axial direction from the guide flange 41*b* for tape running at the upper side, and the tape core 40 of the feed reel 3 is coaxially and rotatably supported on the outer circumference of the rotary shaft 161, and the tape core 40 and the take-up reel 4 are frictionally engaged with each other through engaging protrusions 70, 70, . . . which are frictional engaging members of the clutch mechanism 50.

The clutch mechanism 50 not only constitutes the power transmitting means between the both reels 3, 4 as the intrinsic function same as in the foregoing embodiments, and also functions same as the tape interlocking unit (interlock mechanism) D in the foregoing embodiments, as the rotation drive unit for mutually interlocking the both reels 3, 4.

More specifically, plural engaging protrusions 70, 70, . . . of the clutch mechanism 50 are integrally formed at the inner side of the tape running guide flange 41*b* of the take-up reel 4, and the engaging portions 70*a* are provided so as to project upward from the upper side of the tape running guide flange 41*b* in ordinary state, at the position confronting the axial end face 40*a* of the tape core 40 of the feed reel 3, and are also furnished with engaging flat surfaces corresponding to the flat surface of the axial end face 40*a*.

The rewind button 71 as the engaging support member has its axial engaging portion 75 engaged with the engaging recess 77 in the axial end face 40*b* of the tape core 40, and its detent claw 76 is engaged with the rotary shaft 161 of the take-up reel 4. For this purpose, inside of the rotary shaft 161, there is an engaging flange 78 to be engaged with the detent claw 76 in the axial direction. The constitution of the detent pawl 76 and engaging flange 78 is same as in the foregoing embodiments.

In the both reels 3, 4 thus assembled by the rewind button 71, the rotary shaft 161 of the take-up reel 4 is detachably and rotatably supported on the rotary support shaft 11 of the case main body 5. In this case, to prevent the rotary support shaft 11 from slipping out of the both reels 3, 4, the coat film transfer head H and support board 20 are engaged with the closed case 2.

In the state of the both reels 3, 4 installed in the case 2, the coat film transfer tape T propelled from the feed reel 3 is, although not shown, once guided by a guide pin 57, and is inverted after the leading end pressurizing portion 55 of the coat film transfer head H, and is also guided by a guide pin 58, and taken up on the take-up reel 4.

The other constitution and action are same as in embodiment 1.

Embodiment 14

Figure 29:
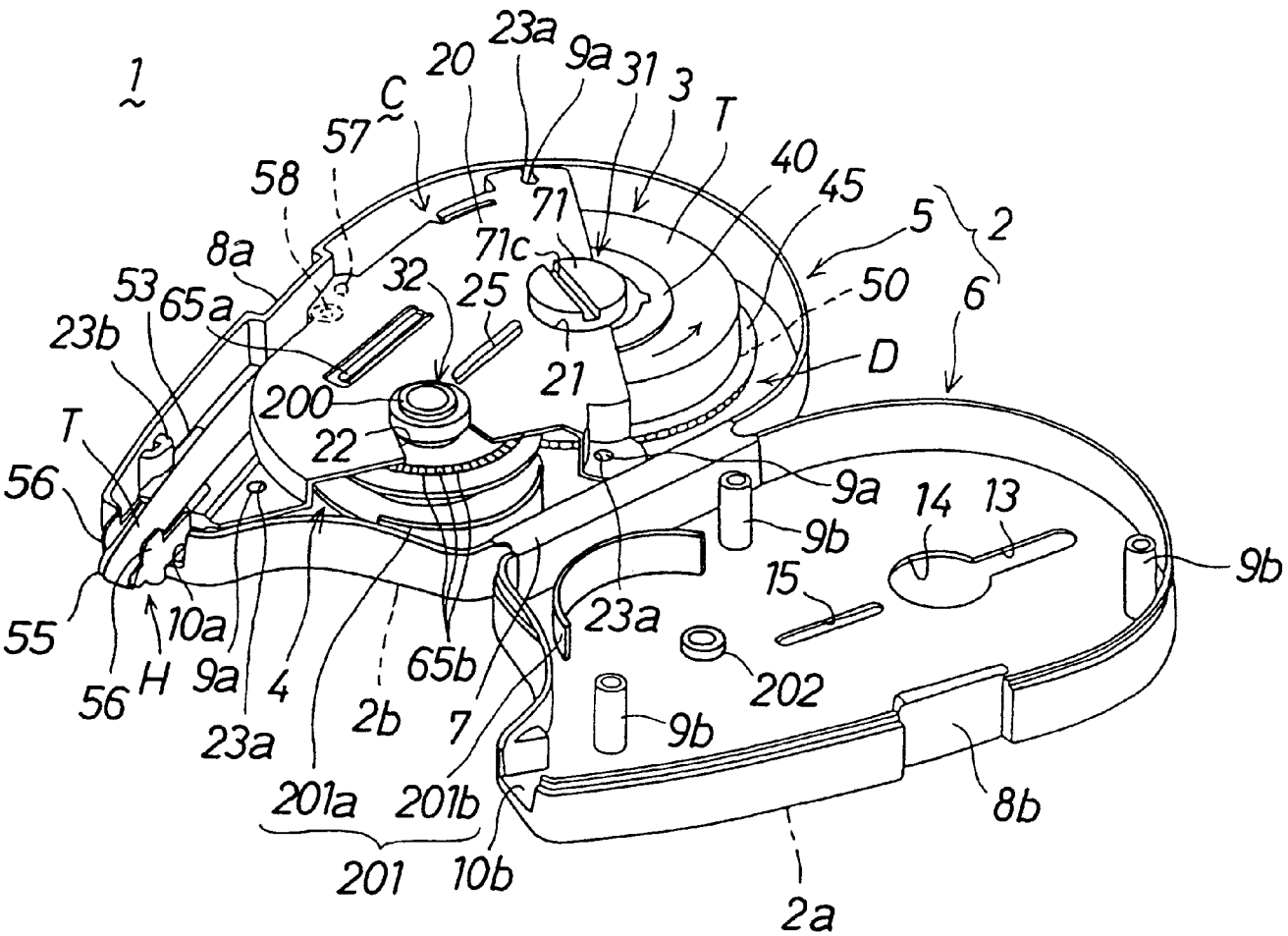
FIG. 29 is a perspective view showing the inside of an eraser by opening the case in embodiment 14 of the invention.
Figure 30:
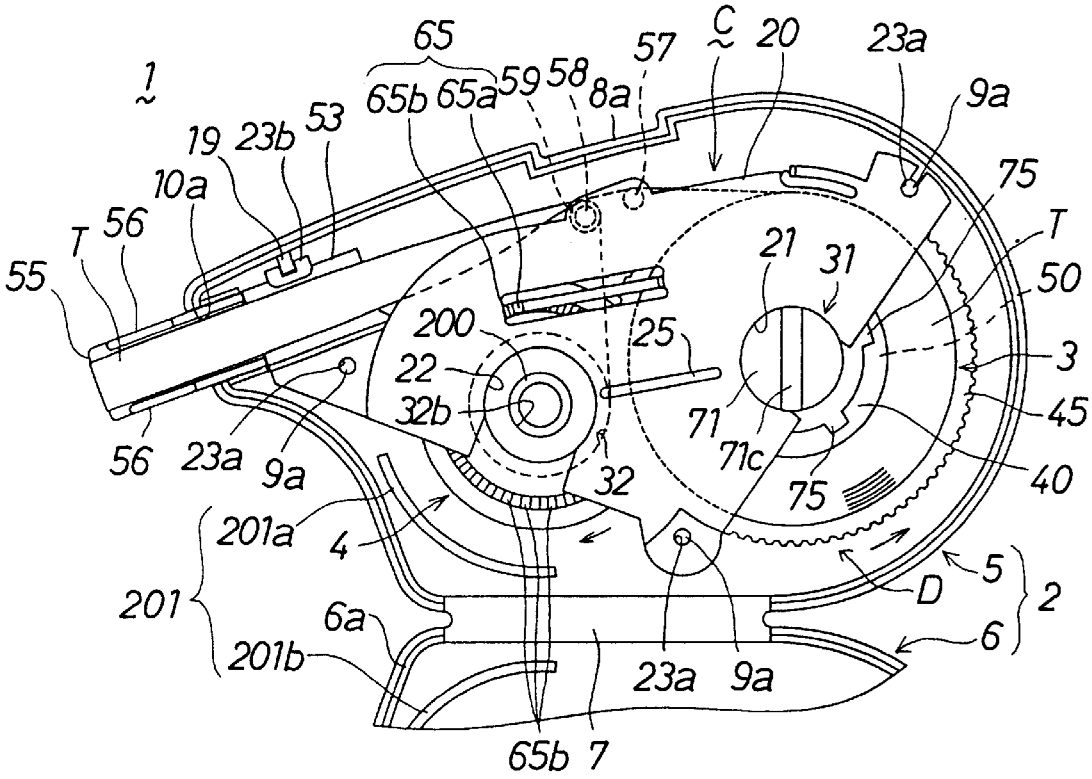
FIG. 30 is a front view showing the inside of the case main body of the eraser.
Figure 31:
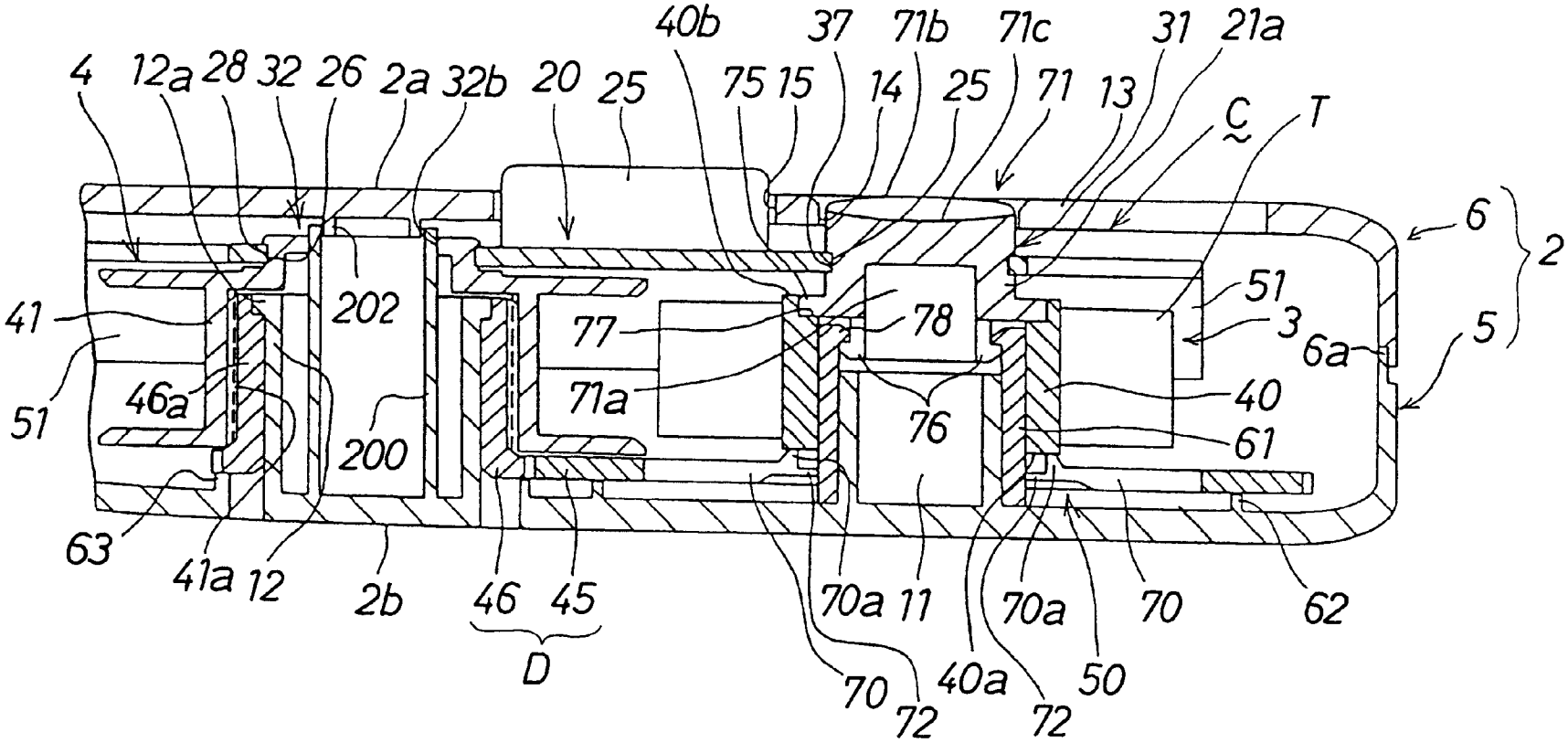
FIG. 31 is a side sectional view showing the inside of principal parts of the eraser.
Figure 32:
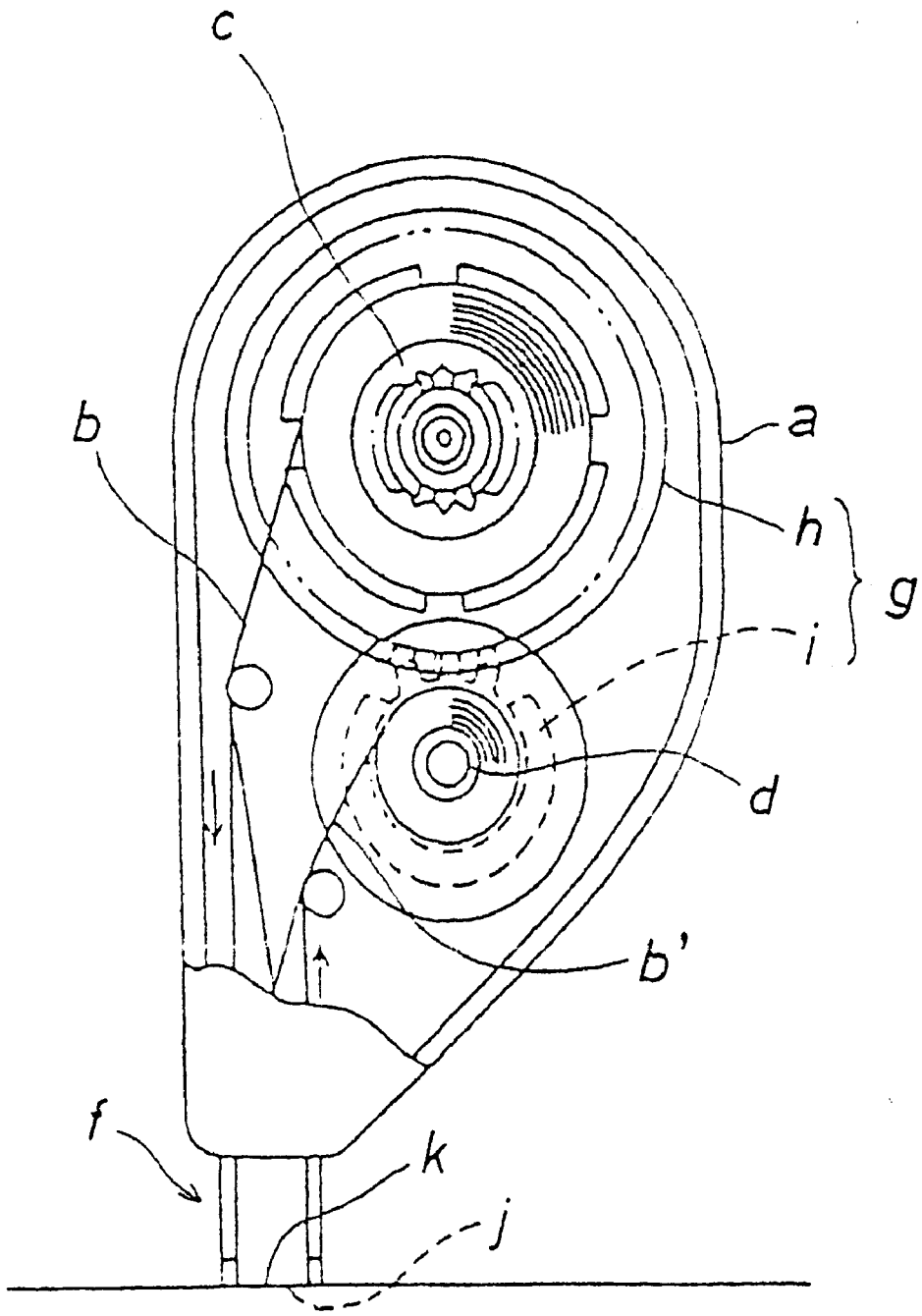
FIG. 32 PRIOR ART
FIG. 32 is a partially cut-away front view of internal constitution of a conventional eraser.
Figure 33:
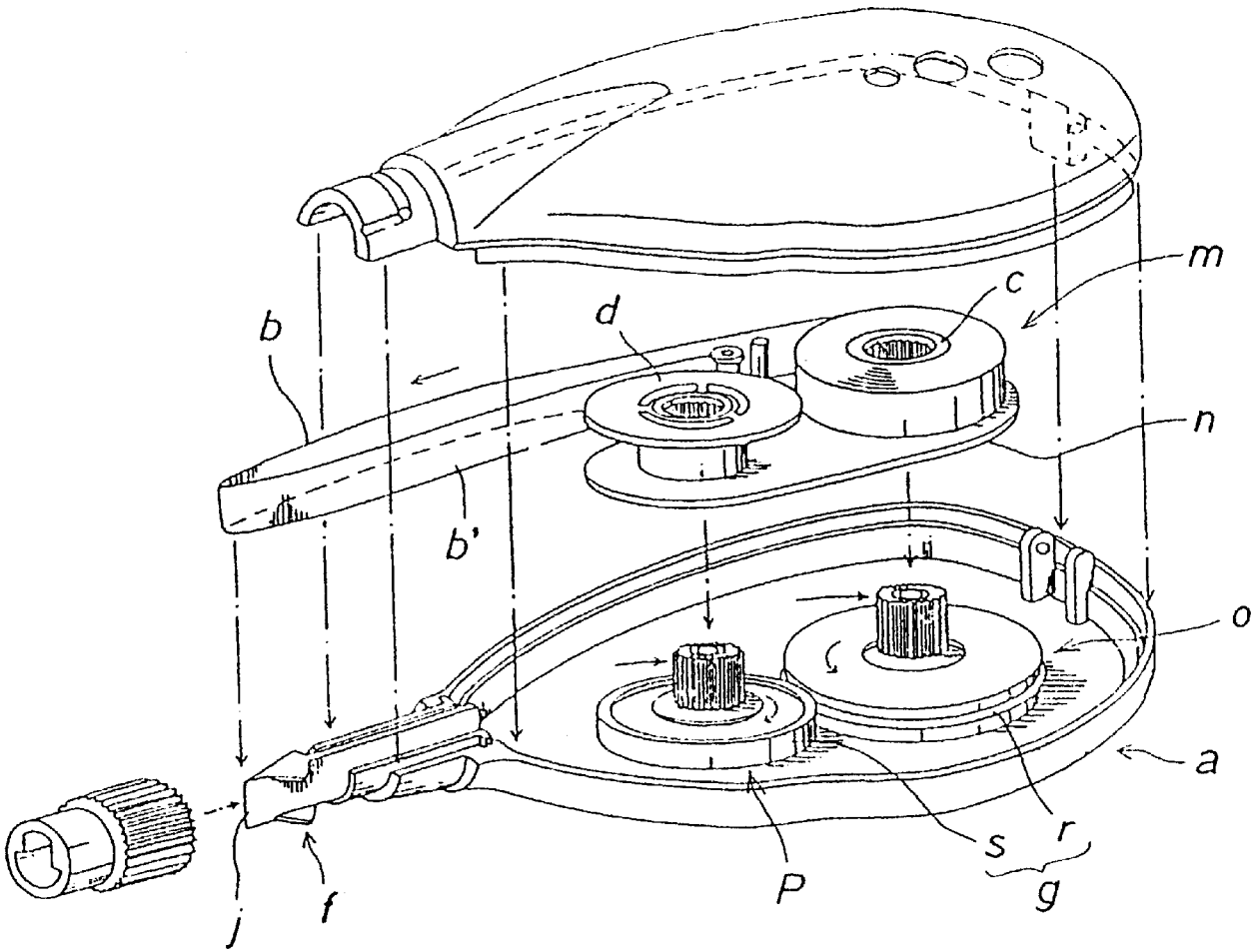
FIG. 33 PRIOR ART
FIG. 33 is a perspective exploded view of other conventional eraser.

This embodiment is shown in FIG. 29 through FIG. 31, in which the constitution of the case 2 is slightly modified.

That is, the case 2 of the embodiment incorporates spacer means for distributing the gripping force applied on the confronting gripping surfaces 2*a*, 2*b* of the case 2.

The location of the spacer means is at least the position exposed to a strong gripping force by the user, and more specifically, in the holding position shown in FIG. 12, the position of the confronting gripping surfaces 2*a*, 2*b* of the case 2 held by the thumb and the middle finger, that is, the location of the take-up reel 4.

The spacer means in the embodiment includes a first spacer portion 200 and a second spacer portion 201.

The first spacer portion 200 is provided coaxially with the rotary support shaft 11, and more specifically it is formed as a spacer shaft integrally formed coaxial inside the hollow rotary support shaft 11, at the inner side of the case main body 5. This spacer shaft 200 is a hollow cylindrical form, and is set in the length corresponding to the height between the inner side faces of the case 2 as shown in FIG. 31, and a fitting support portion 202 to be fitted with the spacer shaft 200 is provided at the inner side of the cap body 6. In correspondence thereto, at the end face of the rotary shaft 32 of the take-up reel 4, an insertion hole 32*b* for inserting the spacer shaft 200 is opened.

The second spacer portion 201 is provided on the outer circumference of the take-up reel 4, and more specifically it is formed as a spacer rib integrally formed so as to surround the outer circumference of the take-up reel 4, at the both inner sides of the case main body 5 and cap body 6. This spacer rib 201 is composed of a pair of plate ribs 20*a*, 201*b* provided oppositely to the inner sides of the case main body 5 and cap body 6, respectively. These plate ribs 201*a*, 201*b* are in flat arc shape surrounding the outer circumference of the take-up reel 4, and, although not shown in the drawing, it is set at the height corresponding to the height between the inner side faces of the case 2, and both leading end edges abut against each other.

In the state of closing the case 2 by putting the cap body 6 on the case main body 5, the spacer shaft 200 and fitting support portion 202 are engaged with each other, and the plate ribs 201*a*, 201*b* abut against each other. These spacer means 200, 201 cooperate with the opening edges of the case main body 5 and cap body 6, and the fitting structure of three pairs of positioning and fitting portions 9*a*, 9*b*, and distribute the gripping force applied to the gripping surfaces 2*a*, 2*b* of the case 2 by the user, so that a smooth driving of the take-up reel 4 is realized.

Such spacer structure is particularly effective when set in a small wall thickness for the purpose of saving the material and reducing the weight of the case 2.

The other constitution and action are same as in embodiment 1.

Not limited to the foregoing embodiments 1 to 14, the invention may be also modified, for example, as follows.

(1) In the illustrated embodiments, the head insertion portion 10 of the case 2 function also as the rotating angle defining portion for defining the rotating angle of the coat film transfer head H, but a rotating angle defining portion may be provided independently.

(2) In the illustrated embodiments, the clutch mechanism 50 is disposed at the feed reel 3 side, but it may be also disposed at the take-up reel 4 side depending on the purpose, or may be further installed at both reels 3, 4. When the clutch mechanism is provided at both reels 3, 4, in the rewinding operation by the tape rewind mechanism, application of excessive tension on the coat film transfer tape T may be effectively prevented.

(3) Instead of the corrective paint layer of the coat film transfer tape T in the illustrated coat film transfer tool, by using a paint layer of transparent fluorescent color, the applied position of the paint layer may be visually emphasized, so that it may be used also as a so-called marker coat film transfer tool.

(4) As the coat film transfer tape T, by forming an adhesive layer on one side of a film base material through a parting layer, the coat film transfer tool may be used as a glue applicator for transferring only the adhesive layer on the sheet of paper.

(5) The specific constitution of the constituent parts of the tape cartridge C, in particular, the base end support portion 52 of the coat film transfer head H and the head holding portion 53 of the support board 20 is not limited to the illustrated embodiments alone as far as the specified purposes are achieved.

As described herein, according to the invention, various unique effects are obtained as listed below, and in the refill type coat film transfer tool for horizontal drawing use, the coat film transfer tape can be replaced easily and quickly, and it can be used just like a writing tool corresponding to the manner of holding a writing tool by each user, and such small and simple structure is presented at low cost.

(1) In the tape cartridge of the invention, a rotatable feed reel winding a coat film transfer tape thereon, a rotatable take-up reel for recovering the coat film transfer tape after use, and a coat film transfer head for pressing the coat film transfer tape on a transfer area are provided on a flat support board, so that it can be replaced instantly.

That is, the support board rotatably supports the opposite side ends of rotary shafts of both reels supported on the rotary support shaft of the case, and setting of the coat film transfer tape on the coat film transfer head is already completed in the stage of product.

Accordingly, the user has only to grip the support board to cause the rotary shaft of the reel to be engaged with the rotary support shaft of the case from the upper side, and put the tape cartridge into the case while positioning the coat film transfer head into the leading end specified position of the case, so that replacement is over.

(2) Since the leading end support portion of the coat film transfer head is supported on the head holding portion of the support board rotatably around the head axial center, in the state of the tape cartridge being placed in the case, the coat film transfer head can be rotated about the case axial center in a rotating angle range defined by the rotating angle defining portion of the head insertion portion of the case, and therefore the head position may be kept at a desired position depending on the application or the manner of holding by the user. It means that in the coat film transfer tool of the invention, if the basic structure of the head is designed for a right-handed user, a left-handed user can hold the head position in a desired position, same as a right-handed user, depending on the manner of holding by the left-handed user.

In particular, the rotating angle defining portion is designed to set to allow the coat film transfer head to rotate so that the leading end pressurizing portion of the coat film transfer head may rotate in a specified angle range in both directions, from the center of angle of guiding the coat film transfer tape almost oppositely to the gripping surfaces of the case, and therefore the user can hold the coat film transfer tool in a position same as when holding a writing tool, so that it can be used in horizontal drawing same as when using a writing tool, so that a favorable sense of manipulation is obtained.

(3) In the clutch mechanism, since the tape core and the rotary drive unit are frictionally engaged with each other in the rotating direction by the power transmitting means for making use of the frictional force by thrust load, in its synchronizing action, the constituent members relatively slide smoothly, and the sense of manipulation is excellent, and uneven running does not occur.

The frictional engaging force of the power transmitting means can be set to an optimum value by properly adjusting the engaging dimensional relation of the rotary drive unit and engaging support member in the axial direction and setting the axial engaging force of the two, and as compared with the type of making use of the frictional force by radial load, the designing and manufacturing conditions of the constituent members are less strict, and manufacture is easy, and it is also easy to assemble, and the manufacturing cost and the device cost can be lowered.

Moreover, the constitution of the clutch mechanism is simple and the number of constituent parts is small, and manufacture is easy and a high assembling precision is obtained, and in this respect, too, the cost of the coat film transfer tool may be saved.

As the invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A tape cartridge for coat film transfer tool replaceably installed in a case of an automatic winding type coat film transfer tool constituted so as to mutually rotate a feed reel winding a coat film transfer tape thereon and a take-up reel for recovering the coat film transfer tape after use, comprising:

a support board, a feed reel rotatably provided on said support board, having a coat film transfer tape wound thereon, a take-up reel rotatably provided on said support board, for recovering the coat film transfer tape after use, and a coat film transfer head provided on said support board, for pressing the coat film transfer tape on a transfer area, wherein said support board rotatably supports the opposite side ends of the rotary shafts of both reels detachably and rotatably supported on a rotary support shaft of the case, and said coat film transfer head has its base end support portion held on a head support portion of said support board, rotatably about the head axial center.

2. A tape cartridge for coat film transfer tool of claim 1, wherein a bearing for rotatably supporting the rotary shafts of the both reels is provided near the outer peripheral edge of said support board, and with both reels supported on said bearing, part of the both reels is exposed and arranged outside from the outer peripheral edge of said support board.

3. A tape cartridge for coat film transfer tool of claim 1, wherein the base end support portion of said coat film transfer head is formed of a columnar bar extending along the head axial center, and the head holding portion of said support board is formed as a holding hole for inserting and holding the columnar bar of said coat film transfer head rotatably about its axial center.

4. A tape cartridge for coat film transfer tool of claim 1, wherein the base end support portion of said coat film transfer head is formed of a pair of thin linear bars extending parallel the head axial direction, and the head holding portion of said support board has a cylindrical inner surface for oscillatably supporting the pair of linear bars of said coat film transfer head.

5. A tape cartridge for coat film transfer tool of claim 1, wherein the base end support portion of said coat film transfer head is formed of a plate member extending in the head axial direction, and the head holding portion of said support board has a cylindrical inner surface for oscillatably supporting the both side edges of the plate member of said coat film transfer head.

6. A tape cartridge for coat film transfer tool of claim 1, wherein the base end support portion of said coat film transfer head is formed of bar shaft extending in the head axial direction, and the head holding portion of said support board has a cylindrical inner surface for supporting this shaft of the coat film transfer head, and the shaft of said coat film transfer head is rotatably supported on the cylindrical inner surface of the head holding portion of the support board in a frictional engagement state through an annular frictional member.

7. A tape cartridge for coat film transfer tool of claim 6, wherein said annular frictional member is composed of an elastic frictional member such as rubber.

8. A tape cartridge for coat film transfer tool of claim 1, wherein the base end support portion of said coat film transfer head is formed of a spherical member, and the head holding portion of said support board has a spherical inner surface for rotatably supporting the spherical member of said coat film transfer head.

9. A tape cartridge for coat film transfer tool of claim 1, wherein the rotary support structure of the rotary shafts of the reels in said support board has a bearing formed on the outer circumference of the support board, and an annular engaging groove formed on the entire circumference of the opposite said ends of the rotary shafts of the reels is rotatably engaged and supported on this bearing, and said bearing has a recess bearing form opened to the outer peripheral edge of said support board, and has a shape and size for supporting the rotary shafts of said reels rotatably at a specified position.

10. A tape cartridge for coat film transfer tool of claim 1, wherein tape position converting means for converting the running position of the coat film transfer tape is provided between the both reels and the coat film transfer head in said support board.

11. A tape cartridge for coat film transfer tool of claim 1, wherein a clutch mechanism for synchronizing the feed speed and take-up speed of the coat film transfer tape at both reels is provided in at least one of said both reels.

12. A tape cartridge for coat film transfer tool of claim 11, wherein said clutch mechanism comprises a cylindrical tape core having the coat film transfer tape wound thereon, a rotary drive unit for rotating and driving this tape-core, and an engaging support member to be engaged with this rotary drive unit in the axial direction, and said tape core is held and supported from both sides in the axial direction by the rotary drive unit and engaging support member, and said tape core and rotary drive unit are frictionally engaged with each other in the rotating direction by power transmitting means for making use of frictional force by thrust load.

13. A tape cartridge for coat film transfer tool of claim 12, wherein the power transmitting means of said clutch mechanism is composed of plural frictional engaging members elastically deformable in the axial direction, being integrally formed at least in one of said rotary drive unit and engaging support member, and these frictional engaging members are elastically engaged with the axial end face of the tape core with a specific pressing force, by the axial engaging force of said rotary drive unit and engaging support member.

14. A tape cartridge for coat film transfer tool of claim 13, wherein said tape core is coaxially and rotatably supported on the rotary shaft of said rotary drive unit, and the frictional engaging members of said power transmitting means are engaging protrusions integrally formed at plural positions in the circumferential direction at least in one of said rotary drive unit and engaging support members, and these engaging protrusions are elastically deformable in the axial direction, and are also elastically engaged with the flat axial end face confronting the tape core with a specified pressing force, by the axial engaging force of said rotary drive unit and engaging support member.

15. A tape cartridge for coat film transfer tool of claim 14, wherein the engaging protrusions of said power transmitting means are integrally formed at plural positions in the circumferential direction of said rotary drive unit, and are also elastically engaged with the flat axial end face confronting the tape core with a specified pressing force, by the axial engaging force of said rotary drive unit and engaging support member.

16. A tape cartridge for coat film transfer tool of claim 14, wherein the engaging protrusions of said power transmitting means are integrally formed at plural positions in the circumferential direction of said engaging support member, and are also elastically engaged with the flat axial end face confronting the tape core with a specified pressing force, by the axial engaging force of said rotary drive unit and engaging support member.

17. A tape cartridge for coat film transfer tool of claim 14, wherein the engaging protrusions of said power transmitting means are integrally formed at plural positions in the circumferential direction of said rotary drive unit and engaging support member, and are also elastically engaged with the flat axial end face confronting the tape core with a specified pressing force, by the axial engaging force of said rotary drive unit and engaging support member.

18. A tape cartridge for coat film transfer tool of claim 14, wherein said engaging support member includes an axial engaging portion to be engaged with the axial end face of said tape core, and a detent claw to be engaged with the rotary shaft of said rotary drive unit, and by the engaging force of the axial engaging portion to the tape core when the detent claw of the engaging support members engaged with the support portion of the rotary drive unit, the engaging protrusion is elastically engaged with the flat axial end face confronting the tape core with a specified pressing force.

19. A tape cartridge for coat film transfer tool of claim 18, wherein the detent claw of said engaging support member is elastically deformable in the radial direction, and an engaging flange to be engaged with the detent claw in the axial direction is provided in the inner circumference of the rotary shaft of said rotary drive unit, and said detent claw is elastically deformed to the inner side in the radial direction to pass in the axial direction, and is elastically restored to be engaged with this engaging flange.

20. A tape cartridge for coat film transfer tool of claim 18, wherein the detent claw of said engaging support member is detachably engaged with the rotary shaft of said rotary drive unit.

21. A tape cartridge for coat film transfer tool of claim 18, wherein said engaging support member includes a rotary engaging portion to be engaged with the axial end face of said tape core in the rotating direction, and a rotary manipulating portion for rotary manipulation for rewinding.

22. A tape cartridge for coat film transfer tool of claim 21, wherein the axial engaging portion of said engaging support member is formed as an engaging bump to be engaged with the engaging recess formed in the axial end face of said tape core, and functions also as the rotary engaging portion.

23. A tape cartridge for coat film transfer tool of claim 1, wherein said feed reel and take-up reel are independently and rotatably supported on said support board in two-axis type reel structure.

24. A tape cartridge for coat film transfer tool of claim 1, wherein said feed reel and take-up reel are rotatably supported on said support board, coaxially and mutually rotatably, in one-axis type reel structure.

25. A coat film transfer tool of refill type capable of replacing a coat film transfer tape, comprising:

a tape cartridge detachably installed in a case to be held and manipulated by one hand, wherein the tape cartridge includes a support board, a feed reel rotatably provided on this support board, having a coat film transfer tape wound thereon, a take-up reel rotatably provided on said support board, for recovering the coat film transfer tape after use, and a coat film transfer head provided on said support board, for pressing the coat film transfer tape on a transfer area, wherein said support board rotatably supports the opposite side ends of the rotary shafts of both reels detachably and rotatably supported on a rotary support shaft of said case, said coat film transfer head has its base end support portion held on a head support portion of said support board, rotatably about the head axial center, said case incorporates a rotary support shaft for detachably and rotatably supporting the feed reel and take-up reel of said tape cartridge, said both reels are rotated and supported, as being held from both sides by said rotary support shaft and support board of said tape cartridge, and a head insertion portion for projecting the coat film transfer head of said tape cartridge to outside of the case is provided at the leading end of said case, and a part of the outer circumference of said case forms a pair of confronting gripping surfaces so as to be held by one hand in a position of holding a writing tool.

26. A coat film transfer tool of claim 25, wherein said head insertion portion has a rotating angle defining portion for defining the rotating angle of said coat film transfer head.

27. A coat film transfer tool of claim 26, wherein said rotating direction defining portion is designed to allow rotation of said coat film transfer head so as to rotate by a specified angle range in both directions, from the center of the angle of the leading end pressurizing portion of said coat film transfer head guiding said coat film transfer tape nearly oppositely to the gripping surfaces of said case.

28. A coat film transfer tool of claim 25, wherein said tape cartridge has a two-axis type reel structure having said feel reel and take-up reel independently and rotatably supported on said support board, said case incorporates a pair of rotary support shafts for detachably and rotatably supporting the feed reel and take-up reel of said tape cartridge, an interlocking mechanism for interlocking said feed reel and take-up reel is formed by mutually meshing an interlocking gear provided at one side of said both reels and an interlocking gear provided at other side, and one interlocking gear is rotatably supported on the rotary support shaft for supporting one of the reels, and other interlocking gear is integrally formed in the rotary drive unit of the clutch mechanism provided at other reel.

29. A coat film transfer tool of claim 25, wherein said tape cartridge has a one-axis type reel structure having said feed reel and take-up reel rotatably supported on said support board, coaxially and mutually rotatably, and an interlocking mechanism for interlocking said feed reel and take-up reel is composed of power transmitting means of the clutch mechanism provided at one side of said both reels.

30. A coat film transfer tool of claim 25, further comprising:

a tape rewinding mechanism for clearing and eliminating slack of coat film transfer tape between said two reels, wherein this tape rewinding mechanism has an engaging support member of said clutch mechanism provided oppositely to the outside of said case, and a rotary manipulating portion for rotary manipulation for rewinding is formed at the outer end of this engaging support member.

31. A coat film transfer tool of claim 25, wherein said case incorporates spacer means for distributing the gripping force applied to said confronting gripping surfaces.

* * * * *